US008177926B2

(12) United States Patent
Lacasse et al.

(10) Patent No.: US 8,177,926 B2
(45) Date of Patent: May 15, 2012

(54) AMORPHOUS FE100-A-BPAMB ALLOY FOIL AND METHOD FOR ITS PREPARATION

(75) Inventors: Robert Lacasse, Mont Saint-Hilaire (CA); Estelle Potvin, Saint-Bruno-de-Montarville (CA); Michel Trudeau, Longueuil (CA); Julian Cave, Saint-Bruno-de-Montarville (CA); Francois Allaire, Shawinigan (CA); Georges Houlachi, Pointe-Claire (CA)

(73) Assignee: Hydro-Quebec, Montreal, Quebec (CA)

( * ) Notice: Subject to any disclaimer, the term of this patent is extended or adjusted under 35 U.S.C. 154(b) by 81 days.

(21) Appl. No.: 12/525,286

(22) PCT Filed: Feb. 1, 2008

(86) PCT No.: PCT/CA2008/000205

§ 371 (c)(1), (2), (4) Date: Nov. 25, 2009

(87) PCT Pub. No.: WO2008/092265

PCT Pub. Date: Aug. 7, 2008

(65) Prior Publication Data

US 2010/0071811 A1 Mar. 25, 2010

(30) Foreign Application Priority Data

Feb. 2, 2007 (CA) ..... 2576752

(51) Int. Cl.
*C25D 5/08* (2006.01)
*C25D 5/18* (2006.01)

(52) U.S. Cl. ..... 148/518; 148/561; 205/104; 205/148; 205/258

(58) Field of Classification Search ..... 205/67, 205/104, 148, 258; 148/518, 561
See application file for complete search history.

(56) References Cited

U.S. PATENT DOCUMENTS 1,965,559 A 7/1934 Goss
(Continued)

FOREIGN PATENT DOCUMENTS

CA 2 558 466 A1 10/2005
(Continued)

OTHER PUBLICATIONS

Lowenheim, Frederick A., Electroplating, Sponsored by the American Electroplaters' Society, McGraw-Hill, 1978, pp. 138-139.*

(Continued)

*Primary Examiner* — George Wyszomierski
(74) *Attorney, Agent, or Firm* — Buchanan Ingersoll & Rooney

(57) ABSTRACT

Amorphous $Fe_{100-a-b}P_aM_b$ foil, preferably in the form of a free-standing foil, process for its production by electrodeposition or electroforming of an aqueous plating solution, and its uses as a constitutive element of a transformer, generator, motor, pulse applications and magnetic shieldings. "a" is a real number ranging from 13 to 24, b is a real number ranging from 0 to 4, and M is at least one transition element other than Fe. The amorphous $Fe_{100-a-b}P_aM_b$ foil has the properties of being amorphous as established by the X-ray diffraction method, an average thickness greater than 20 micrometers, a tensile strength in the range of 200-1100 MPa, an electrical resistivity of over 120 μΩcm, and at least one of a high saturation induction ($B_s$) greater than 1.4 T, a coercive field (Hc) of less than 40 A/m, a loss ($W_{60}$), at power frequencies (60 Hz), and for a peak induction of at least 1.35 T, of less than 0.65 W/kg, and a relative magnetic permeability ($B/\mu_0H$) greater than 10000, for low values of $\mu_0H$.

15 Claims, 8 Drawing Sheets

U.S. PATENT DOCUMENTS

| | | | | |
|---|---|---|---|---|
| 3,086,927 | A | 4/1963 | Chessin et al. | |
| 3,354,059 | A | 11/1967 | Koretzky | |
| 3,871,836 | A | 3/1975 | Polk et al. | |
| 4,079,430 | A | 3/1978 | Fujishima et al. | |
| 4,101,389 | A | 7/1978 | Uedaira | |
| 4,217,135 | A | 8/1980 | Luborsky et al. | |
| 4,533,441 | A | 8/1985 | Gamblin | |
| 4,758,314 | A * | 7/1988 | Ng | 205/258 |
| 5,032,464 | A | 7/1991 | Lichtenberger | |
| 5,225,006 | A | 7/1993 | Sawa et al. | |
| 5,435,903 | A | 7/1995 | Oda et al. | |
| 6,053,989 | A * | 4/2000 | Orillion et al. | 148/304 |
| 6,844,111 | B2 * | 1/2005 | Mirzoev et al. | 429/218.2 |
| 7,230,361 | B2 | 6/2007 | Hirzel | |
| 2005/0189232 | A1 | 9/2005 | Fels et al. | |
| 2006/0043539 | A1 | 3/2006 | Thomas et al. | |
| 2006/0208606 | A1 | 9/2006 | Hirzel | |

FOREIGN PATENT DOCUMENTS

| | | | |
|---|---|---|---|
| WO | WO 2005/093134 | A3 | 10/2005 |

OTHER PUBLICATIONS

K. Kamei and Y. Maehara, "Magnetic Properties and Microstructure of Electrodeposited Fe-P Amorphous Alloy," *Journal of the Magnetic Society of Japan*, vol. 18 Supplement, No. S1 (1994) pp. 529-535.

Form PCT/ISA/210 (International Search Report) dated May 20, 2008.

Form PCT/ISA/237 (Written Opinion of the International Searching Authority) dated May 20, 2008.

Gordon E. Fish, "Soft Magnetic Materials", Proceedings of the IEEE, vol. 78, No. 6, Jun. 1990, pp. 947-972.

R. H. Pry et al., "Calculation of the Energy Loss in Magnetic Sheet Materials Using a Domain Model", Journal of Applied Physics, vol. 29, No. 3, Mar. 1958, pp. 532-533.

I. Ichijima et al., "Improvement of Magnetic Properties in Thinner Hi-B With Domain-Refinement", IEEE Transactions on Magnetics, vol. Mag-20, No. 5, Sep. 1984, pp. 1557-1559.

K. I. Arai et al., "Iron Loss of Tertiary Recrystallized Silicon Steel (Invited)", IEEE Transactions on Magnetics, vol. 25, No. 5, Sep. 1989, pp. 3949-3954.

G. Herzer, "Grain Structure and Magnetism of Nanocrystalline Ferromagnets", IEEE Transactions on Magnetics, vol. 25, No. 5, Sep. 1989, pp. 3327-3329.

G. Herzer, "Grain Size Dependence of Coercivity and Permeability in Nanocrystalline Feromagnets", IEEE Transaction on Magnetics, vol. 26, No. 5, Sep. 1990, pp. 1397-1402.

Tetsuya Osaka et al., "Preparation of Electrodeposited FeP Films and Their Soft Magnetic Properties", Journal of the Magnetics Society of Japan, vol. 18, Supplement, No. S1, 1994, 4 pages.

K. Kamei et al., "Structure and Magnetic Properties of Pulse-Plated Fe-P and Fe-Cu-P Amorphous Alloys", Materials Science and Engineering, A181/A182, 1994, pp. 906-910.

* cited by examiner

AMORPHOUS FE100-A-BPAMB ALLOY FOIL AND METHOD FOR ITS PREPARATION

FIELD OF THE INVENTION

The present invention relates to a foil of an amorphous material represented by the formula $Fe_{100-a-b}P_aM_b$, and to a method for the production of said foil.

The material constituting a foil of the invention exhibits properties of a soft magnetic material, in particular high saturation induction, low coercive field, high permeability and low power frequency losses. In addition, said material may have interesting mechanical and electrical properties.

A foil of the invention is of particular interest as ferromagnetic cores of transformers, engines, generators and magnetic shieldings.

BACKGROUND OF THE INVENTION

Magnetic materials that concentrate magnetic flux lines have many industrial uses from permanent magnets to magnetic recording heads. In particular, soft magnetic materials that have high permeability and nearly reversible magnetization versus applied field curves find widespread use in electrical power equipment. Commercial Iron-Silicon transformer steels can have relative permeabilities, as high as 100000, saturation inductions around 2.0 T, resistivities up to 70 μΩcm and 50/60 Hz losses of a few watts/kg. Even though these products possess favourable characteristics, the losses of power transmitted in such transformers represent a significant economic loss. Since the 1940's, grain oriented Fe—Si steels have been developed with lower and lower losses [U.S. Pat. No. 1,965,559 (Goss), (1934) and see, for example, the review article: "Soft Magnetic Materials", G. E. Fish, Proc. IEEE, 78, p. 947 (1990)]. Inspired by the Pry and Bean model [R. H. Pry and C. P. Bean, J. Appl. Phys., 29, p. 532, (1958)] which identifies a mechanism for anomalous losses based on domain wall motion, modern magnetic materials benefit from magnetic domain refinement, for example, by laser scribing [I. Ichijima, M. Nakamura, T. Nozawa and T. Nakata, IEEE Trans Mag, 20, p. 1557, (1984)] or by mechanical scribing. This approach has led to losses around 0.6 W/kg at 60 Hz. By careful control of heat treatment, and mechanical surface etching, very low losses can be obtained in a thin sheet [K. I. Arai, K. Ishiyama and H. Magi, IEEE Trans Mag, 25, p. 3989, (1989)], 0.2 W/kg at 1.7 T and 50 Hz. However, commercially available materials exhibit losses down to 0.68 W/kg at 60 Hz.

Over the last 25 years, a refinement of crystal grain size in many ferromagnetic systems has led to a significant decrease in hysteresis losses. According to Herzer's random anisotropy model [Herzer, G. (1989) IEEE Trans Mag 25, 3327-3329, Ibid 26, p. 1397-1402] for grains (less than about 30 nm diameter) that are of diameter less than the magnetic exchange length, the anisotropy is significantly reduced and very soft magnetic behaviour occurs, characterized by very low coercive field values ($H_c$) below 20 A/m and thus low hysteresis losses. Often, these materials consist of a distribution of nano-crystals embedded in an amorphous matrix, for example: metallic glasses (see U.S. Pat. No. 4,217,135 (Luborsky et al.)). Often, to achieve these desirable properties, a careful stress relief and/or partial recrystallization heat treatment is applied to the material which has been initially produced in a predominantly amorphous state.

Metallic glasses are generally fabricated by a rapid quenching and are usually made of 20% of a metalloid such as silicon, phosphorous, boron or carbon and of about 80% of iron. These films are limited in thickness and width. Moreover, edge-to-edge and end-to-end thickness variation occurs along with surface roughness. The interest of such materials is very limited due to the high costs associated with the production of such materials. Amorphous alloy can also be prepared by vacuum deposition, sputtering, plasma spraying, rapidly quenching and electrodeposition. Typical commercial ribbons have a 25 μm thickness and a 210 mm width.

Electrodeposition of alloys based on the iron group of metals is one of the most important developments in the last decades in the field of metal alloy deposition. FeP deserves special attention as a cost effective soft magnetic material. FeP alloy films can be produced by electrochemical, electroless, metallurgical, mechanical and sputtering methods. Electrochemical processing is extensively used permitting control of the coating composition, microstructure, internal stress and magnetic properties, by using suitable plating conditions and can be done at low cost.

The following provides certain patent examples related to iron-based alloys.

U.S. Pat. No. 4,101,389 (Uedaira) discloses the electrodeposition of an amorphous iron-phosphorous or iron-phosphorous-copper film on a copper substrate from an iron (0.3 to 1.7 molar (M) divalent iron) and hypophosphite (0.07-0.42 M hypophosphite) bath using low current densities between 3 and 20 A/dm$^2$, a pH range of 1.0-2.2. and a low temperature of 30 to 50° C. The P content in the deposited films varies between 12 to 30 atomic % with a magnetic flux density $B_m$ of 1.2 to 1.4 T. There is no production of a free-standing foil.

U.S. Pat. No. 3,086,927 (Chessin et al.) discloses the addition of minor amounts of phosphorus in the iron electrodeposits to harden iron for hard facing or coating of such parts as shafts and rolls. This patent cites adding between 0.0006 M and 0.06 M of hypophosphite in the iron bath at a temperature between 38 to 76° C. over a current density range of 2 to 10 A/dm$^2$. But for fissure-free deposit, the bath is operated at 70° C., at currents lower than 2.2 A/dm$^2$ and at concentrations of sodium hypophosphite monohydrate of 0.009 M. There is no mention of a free-standing foil production.

U.S. Pat. No. 4,079,430 (Fujishima et al.) describes amorphous metal alloys employed in a magnetic head as core materials. Such alloys are generally composed of M and Y, wherein M is at least one of Fe, Ni and Co and Y is at least one of P, B, C and Si. The amorphous metal alloys used are presented as a combination of the desirable properties of conventional permalloys with those of conventional ferrites. The interest of these materials as a constitutive element of a transformer is, however, limited due to their low maximum flux density.

U.S. Pat. No. 4,533,441 (Gamblin) describes that iron-phosphorous electroforms may be fabricated electrically from a plating bath which contains at least one compound from which iron can be electrolytically deposited, at least one compound which serves as a source of phosphorus such as hypophosphorous acid, and at least one compound selected from the group consisting of glycin, beta-alanine, DL-alanine, and succinic acid. The alloy thereby obtained, that is always prepared in presence of an amine, is characterised neither for its crystalline structure nor by any mechanical or electromagnetic measures and can only be recovered from the flat support by flexing the support.

U.S. Pat. No. 5,225,006 (Sawa et al.) discloses a Fe-based soft magnetic alloy having soft magnetic characteristics with high saturation magnetic flux density, characterized in that it has very small crystal grains. The alloy may be treated to cause segregation of these small crystal grains.

The following provides certain patent examples related to cobalt and nickel phosphorous alloys.

U.S. Pat. No. 5,435,903 (Oda et al.) discloses a process for the electrodeposition of a peeled foil-shaped or tape-shaped product of CoFeP having good workability and good soft magnetic properties. The amorphous alloy contains at least 69 atomic % of Co and 2 to 30 atomic % of P. There is no mention of a FeP amorphous alloy.

U.S. Pat. No. 5,032,464 (Lichtenberger) discloses an electrodeposited amorphous alloy of NiP as a free-standing foil of improved ductility. There is no mention of a FeP amorphous alloy.

The following provides certain examples of publications related to FeP alloys. Several papers were concerned with the formation of FeP deposits on a substrate with good soft magnetic properties.

T. Osaka et al., in "Preparation of Electrodeposited FeP Films and their Soft Magnetic Properties", [Journal of the Magnetic Society of Japan Vol. 18, Supplement, No. S1 (1994)], mentions electrodeposited FeP films, and the most suitable FeP alloy film exhibits a minimum coercive field, 0.2 Oe, and a high saturation magnetic flux density, 1.4 T, at the P content of 27 atomic %. In order to improve the magnetic properties, in particular the permeability, a magnetic field heat treatment was adopted, and the permeability was increased to 1400. The most suitable film was found to be a hyper-fine crystalline structure. The thermal stability of the FeP film was also confirmed to be up to 300° C. (annealing without magnetic field in vacuum).

K. Kamei and Y. Maehara [J. Appl. Electrochem., 26, p. 529-535 (1996)] found the lowest $H_c$ of about 0.05 Oe obtained with an electrodeposited and annealed FeP amorphous alloy, with phosphorous content of about 20 atomic %. This paper cites adding up to 0.15 M of sodium hypophosphite in the iron bath at a temperature of 50° C. over a current density of 5 A/dm$^2$ and a pH of 2.0. K. Kamei and Y. Maehara [Mat. Sc. And Eng., A181/A182, p. 906-910 (1994)] used a pulsed-plating bath to electrodeposit FeP and FePCu on a substrate and a low $H_c$ value of 0.5 Oe was obtained for the FePCu at a relatively high current density of 20 A/dm$^2$.

The microstructure of electrodeposited FeP deserves large attention in the literature. It was established that the crystallographic structure of FeP electrodeposited film gradually changes from crystalline to amorphous with increasing P content in the deposited film until 12-15 atomic %.

There was a need for new amorphous material free of at least one of the drawbacks traditionally associated with the available amorphous material.

There was also a need for a new amorphous material presenting improved mechanical and/or electromagnetic and/or electrical properties, in particular good soft magnetic properties that are very useful for different applications.

There was also a need for a new process allowing the preparation of an amorphous free foil with predetermined mechanical and/or electromagnetic properties, in particular with a low stress and good soft magnetic properties. There was particularly a need for an economic process for producing such materials.

There was also a need for a new practical, efficient and economic process for producing amorphous foils with a thickness up to 250 microns and without limitation in the size of the foil.

There was, therefore, a need for a new amorphous material as free-standing foil free of at least one of the drawbacks of known amorphous materials and presenting the magnetic properties, namely high saturation induction, low coercive field, high permeability and low power frequency losses, which are required when the material is used to form the ferromagnetic cores of transformers, motors, generators and magnetic shieldings.

SUMMARY OF THE INVENTION

A first object of the present invention is constituted by an amorphous $Fe_{100-a-b}P_aM_b$ alloy foil, in the form of a free-standing foil, wherein:

- said foil has an average thickness in the range 20 μm-250 μm, preferably greater than 50 μm, more preferably greater than 100 μm;
- in formula $Fe_{100-a-b}P_aM_b$, a is a number ranging from 13 to 24, b is a real number ranging from 0 to 4, and M is at least one transition element other than Fe;
- the alloy has an amorphous matrix in which nanocrystals having a size lower than 20 nm may be embedded, and the amorphous matrix occupies more than 85% of the volume of the alloy.

In a preferred embodiment, the nanocrystals have a size lower than 5 nm, and the amorphous matrix occupies more than 85% of the volume of the alloy. The magnetic properties are enhanced if the size of the nanoparticles is lower and if the ratio of the nanoparticles in the alloy is lower. Particularly preferred are alloys without nanoparticles.

X-ray diffraction (XRD) characterization shows the amorphous structure of the alloy. The transmission electron microscope (TEM) characterization shows the nanoparticles if they are present in the amorphous alloy.

In the present specification, "amorphous" means a structure which appears amourphous by XRD characterization as well as a structure wherein nanocrystals are embedded in an amorphous matrix characterized by TEM.

An amorphous $Fe_{100-a-b}P_aM_b$ alloy foil of the invention has a tensile strength that is in the range of 200-1100 MPa, preferably over 500 MPa, and a high electrical resistivity ($\rho_{dc}$) of over 120 μΩcm, preferably over 140 μΩcm and more preferably over 160 μΩcm.

The amorphous $Fe_{100-a-b}P_aM_b$ alloy constituting the foil of the invention is a soft magnetic material which has at least one of the following additional properties:

- a high saturation induction ($B_s$) that is greater than 1.4 T, preferably greater than 1.5 T and more preferably greater than 1.6 T;
- a low coercive field ($H_c$) of less than 40 A/m, preferably less than 15 A/m and more preferably less than 11 A/m, at an induction of 1.35 T;
- a low loss ($W_{60}$), at power frequencies (60 Hz), and for a peak induction of at least 1.35 T, of less than 0.65 W/kg, preferably of less than 0.45 W/kg and more preferably of less than 0.3 W/kg; and
- a high relative magnetic permeability ($B/\mu_oH$) for low values of $\mu_oH$, greater than 10000, preferably greater than 20000 and more preferably greater than 50000.

Considering its magnetic properties, an amorphous $Fe_{100-a-b}P_aM_b$ alloy foil of the invention is useful to form the ferromagnetic cores of transformers, motors, generators and magnetic shieldings.

The magnetic losses of the alloy of the present invention are improved when the phosphorus content is higher. However, a higher content of P is detrimental for the coulombic efficiency when the alloy is prepared by electrodeposition. If the phosphorus content "a" is lower than 13, the $Fe_{100-a-b}P_aM_b$ alloy foil is no longer amorphous as revealed by XRD and consequently, the magnetic properties are not good enough to use the alloy as the core of a transformer. If "a" is higher than 24, the coulombic efficiency is low and the electrodeposition process for the preparation of the alloy is not interesting from an economic point of view. Moreover, the saturation magnetization decreases with increasing content of P in the foil. In a preferred embodiment, the phosphorus content "a" ranges from 15.5 to 21.

In the amorphous $Fe_{100-a-b}P_aM_b$ foil of the invention, M may be a single element selected in the group consisting of Mo, Mn, Cu, V, W, Cr, Cd, Ni, Co, Zn and or combination of at least two of said elements. Preferably, M will be Cu, Mn, Mo or Cr. Cu is particularly preferred because it enhances resistance to corrosion of the alloy. Mn, Mo and Cr provide better magnetic properties.

The material constituting a foil of the invention generally comprises unavoidable impurities resulting from the preparation process or the precursors used for the process. The impurities most commonly present in the amorphous $Fe_{100-a-b}P_aM_b$ foil of the present invention are oxygen, hydrogen, sodium, calcium, carbon, electrodeposited metallic impurities other than Mo, Mn, Cu, V, W, Cr, Cd, Ni, Co, or Zn. Materials that comprises less than 1% by weight, preferably less than 0.2% and more preferably less than 0.1% by weight of impurities, are of a particular interest.

A foil of the present invention may be made of an amorphous alloy having one of the following formulae

- $Fe_{100-a-b}P_aCu_{b'}$, wherein a ranges from 15 to 21 and is preferably about 17, and b' ranges from 0.2 to 1.6 and is preferably about 0.8;
- $Fe_{100-a-b}P_aMn_{b'}$, wherein a ranges from 15 to 21 and is preferably about 17, and b' ranges from 0.2 to 1.6 and is preferably about 0.8;
- $Fe_{100-a-b}P_aMo_{b''}$, wherein a ranges from 15 to 21 and is preferably about 17, and b" ranges from 0.5 to 3 and is preferably about 2; and
- $Fe_{100-a-b}P_aCr_{b''}$, wherein a ranges from 15 to 21 and is preferably about 17, and b" ranges from 0.5 to 3 and is preferably about 2.

Some other amorphous $Fe_{100-a-b}P_aM_b$ alloy foils are those wherein:

- $M_b$ is $Cu_{b'}Mo_{b''}$, i.e. those of formula $Fe_{100-a-b'-b''}P_aCu_{b'}Mo_{b''}$, wherein a ranges from 15 to 21 and is preferably about 17; b' ranges from 0.2 to 1.6 and is preferably about 0.8; and b" ranges from 0.5 to 3 and is preferably about 2.
- $M_b$ is $Cu_{b'}Cr_{b''}$, i.e. those of formulae $Fe_{100-a-b'-b''}P_aCu_{b'}Cr_{b''}$, wherein a ranges from 15 to 21 and is preferably about 17; b' ranges from 0.2 to 1.6 and is preferably about 0.8; and b" ranges from 0.5 to 3 and is preferably about 2.
- $M_b$ is $Mn_{b'}Mo_{b''}$, i.e. those of formulae $Fe_{100-a-b'-b''}P_aMn_{b'}Mo_{b''}$, wherein a ranges from 15 to 21 and is preferably about 17; b' ranges from 0.2 to 1.6 and is preferably about 0.8; and b" ranges from 0.5 to 3 and is preferably about 2.
- $M_b$ is $Mn_{b'}Cr_{b''}$; i.e. those of formulae $Fe_{100-a-b'-b''}P_aMn_{b'}Cr_{b''}$, wherein a ranges from 15 to 21 and is preferably about 17; b' ranges from 0.2 to 1.6 and is preferably about 0.8; and b" ranges from 0.5 to 3 and is preferably about 2.

Of particular interest are amorphous $Fe_{100-a-b}P_aM_b$ alloys selected in the group consisting of:

- $Fe_{83.8}P_{16.2}$, $Fe_{78.5}P_{21.5}$, $Fe_{82.5}P_{17.5}$ and $Fe_{79.7}P_{20.3}$
- $Fe_{83.5}P_{15.5}Cu_{1.0}$, $Fe_{83.2}P_{16.6}Cu_{0.2}$, $Fe_{81.8}P_{17.8}Cu_{0.4}$, $Fe_{82.0}P_{16.6}Cu_{1.4}$, $Fe_{82.9}P_{15.5}Cu_{1.6}$, $Fe_{83.7}P_{15.8}Mo_{0.5}$, and $Fe_{74.0}P_{23.6}Cu_{0.8}Mo_{1.6}$;
- $Fe_{83.5}P_{15.5}Mn_{1.0}$, $Fe_{83.2}P_{16.6}Mn_{0.2}$, $Fe_{81.8}P_{17.8}Mn_{0.4}$, $Fe_{82.0}P_{16.6}Mn_{1.4}$, $Fe_{82.9}P_{15.5}Mn_{1.6}$, $Fe_{83.7}P_{15.8}Mn_{0.5}$, and $Fe_{74.0}P_{23.6}Mn_{0.8}Mo_{1.6}$.

A second object of the present invention is a process for the preparation of an amorphous $Fe_{100-a-b}P_aM_b$ alloy foil according to the first object of the present invention.

An amorphous $Fe_{100-a-b}P_aM_b$ alloy foil of the present invention is obtained by electrodeposition using an electrochemical cell having a working electrode which is the substrate for the alloy deposition and an anode, wherein said electrochemical cell contains an electrolyte solution which acts as a plating solution and a dc current or a pulse current is applied between the working electrode and the anode, and wherein:

- the plating solution is an aqueous solution with a pH ranging from 0.8 to 2.5 and a temperature ranging from 40° C. to 105° C., and containing:
  - an iron precursor, preferably at a concentration ranging from 0.5 to 2.5 M, selected from the group consisting of a clean iron scrap, iron, pure iron, and a ferrous salt, said ferrous salt preferably selected in the group consisting of $FeCl_2$, $Fe(SO_3NH_2)_2$, $FeSO_4$ and mixtures thereof;
  - a phosphorus precursor, preferably selected in the group consisting of $NaH_2PO_2$, $H_3PO_2$, $H_3PO_3$, and mixtures thereof, at a concentration ranging from 0.035-1.5 M; and
  - optionally a M salt at a concentration ranging from 0.1 to 500 mM;
- a dc or pulse current is applied between the working electrode and the anode with a density ranging from 3 to 150 $A/dm^2$;
- velocity of the aqueous plating solution ranges from 1 to 500 cm/s.

The pH of the aqueous plating solution is preferably adjusted during its preparation by addition of at least one acid and/or at least one base.

A process as defined above provides alloy deposition with a coulombic efficiency that is higher than 50%. In some specific embodiments, the coulombic efficiency might be higher than 70%, or even as high as 83%.

The process of the invention is advantageously used to prepare an amorphous $Fe_{100-a-b}P_aM_b$ alloy as a free-standing foil. The free standing foil may be obtained by peeling from the working electrode the foil deposited thereon.

DETAILED DESCRIPTION

According to a preferred embodiment, the process of the invention is performed with at least one of the following specifications:

- maintaining the ferric ion concentration in the aqueous plating solution at a low level by reducing ferric ions by recirculating the aqueous plating solution in a chamber, called a regenerator, containing iron chips having preferably a purity level higher than 98.0 weight %;
- using materials with low carbon impurities;
- filtering the aqueous plating solution, preferably with a filter of about 2 μm, in order to control of the amount of carbon in the amorphous $Fe_{100-a-b}P_aM_b$ foil and/or to eliminate the ferric compound which may precipitate in the aqueous plating solution;
- using activated carbon in order to lower the amount of organic impurities,
- performing an electrolysis treatment (dummying) at the beginning of the formation of the amorphous $Fe_{100-a-b}P_aM_b$ foil in order to reduce the concentration of metallic impurities in the aqueous plating solution and thus, in the foil.

Preferably, the process is carried out in the absence of oxygen, and preferably in the presence of an inert gas such as nitrogen or argon. The performances of the process may be improved when:

- the aqueous plating solution is, prior to its use, bubbled with an inert gas;
- an inert gas is maintained over the aqueous plating solution during the process; and
- any entry of oxygen into the cell is prevented.

Advantageously, the working electrode is made of an electroconductive metal or metallic alloy, and the amorphous $Fe_{100-a-b}P_aM_b$ deposit formed on it upon electrodeposition is peeled off to obtain a free standing foil, preferably by using a knife located on-line or by using an adhesive non-contaminating tape specially designed to resist to the aqueous plating solution composition and temperature. Preferably, the electroconductive metal or metallic alloy forming the working electrode is titanium, brass, hard chrome plated stainless steel or stainless steel, and more preferably titanium.

A working electrode made of titanium is preferably polished before use to promote a poor adhesion of the amorphous $Fe_{100-a-b}P_aM_b$ alloy deposit on the working electrode, the adhesion being however sufficiently high to avoid the detachment of the deposit during the process.

The anode may be made of iron or graphite or DSA (Dimensionally Stable Anode). Advantageously, the anode should have a surface area equal to that of the working electrode or adjusted to a value allowing for control of any edge effect on the cathodic deposit as a result of poor current distribution. When the anode is made of graphite or is a DSA, the ferric ion produced at the anode can be reduced by recirculation of the plating solution in a regenerator containing iron chips. If the anode is made of iron, it may release small dislodged iron particles in the plating solution. An iron anode is therefore preferably isolated from the working electrode by a porous membrane consisting of a cloth bag, sintered glass or a porous membrane made of a plastic material.

According to an embodiment, the process of the invention is performed in an electrochemical cell having a rotating disk electrode (RDE) as the working electrode. The RDE has a surface preferably ranging from 0.9 to 20 $cm^2$ and more preferably of about 1.3 $cm^2$. The anode used may be of iron or graphite or DSA. The anode has at least the same surface dimension than the working electrode and the distance between the two electrodes is typically ranging from 0.5 to 8 cm. A RDE having a rotating rate ranging from 500 to 3000 rpm induced a velocity of the aqueous plating solution ranging from 1 to 4 cm/s.

According to another embodiment, the working electrode is made of static plates, preferably made of titanium. The static plate working electrode is used with a plate anode preferably made of iron or graphite or DSA.

The cell preferably comprises parallel cathode and anode plates. The anode has a surface area equal to that of the working electrode or adjusted to a value allowing for control of any edge effect on the cathodic deposit as a result of poor current distribution. For example, both plates may have a surface of 10 $cm^2$ or of 150 $cm^2$. In this case, the distance between the working electrode and the anode ranges advantageously from 0.3-3 cm and preferably from 0.5 to 1 cm. The velocity of the aqueous plating solution preferably ranges from 100 to 320 cm/s In a particular case, a static plate working electrode may also be placed perpendiculary with a static plate anode having a different dimension. For example, the static plate working electrode of 90 $cm^2$ may also be placed perpendiculary with the static plate anode of 335 $cm^2$ with a distance of 25 cm between the cathode and the anode.

The working electrode may be of the rotating drum type, partly immersed in the aqueous plating solution. In a small size cell, the rotating drum type electrode preferably has a diameter of about 20 cm and a length of about 15 cm. In a large cell, the rotating drum type electrode has preferably a diameter of about 2 m and a length of about 2.5 m. A rotating drum type working electrode is used preferably with a semi-cylindrical curved DSA anode facing the rotating drum cathode. The anode should have a surface area equal to that of the working electrode or adjusted to a value allowing for control of any edge effect on the cathodic deposit as a result of poor current distribution. Preferably, the distance between the working electrode and the anode ranges from 0.3 to 3 cm. The velocity of the aqueous plating solution ranges from 25 to 75 cm/s. The combination of a rotating drum type working electrode with a semi-cylindrical curved anode is particularly useful for a continuous production of the amorphous foil of the invention. An equivalent result would be obtained by replacing the rotating drum electrode with a belt-shape electrode.

Advantageously, the process of the invention may comprise one or more additional steps in order to improve the efficiency of the process or the properties of the alloy obtained An additional step of mechanical or chemical polishing of the amorphous $Fe_{100-a-b}P_aM_b$ foil may be performed for eliminating the oxidation appearing on the surface of the amorphous $Fe_{100-a-b}P_aM_b$ foil.

A thermal treatment may also be performed for eliminating hydrogen, after the amorphous foil is separated from the working electrode.

An further thermal treatment of the amorphous $Fe_{100-a-b}P_aM_b$ foil may be performed for eliminating the mechanical stress and for controlling the magnetic domain structure, at a temperature ranging from 200 to 300° C. The treatment time depends on the temperature. It ranges from around 10 seconds at 300° C., to around 1 hour at 200° C. For instance, it would be about half an hour around 265° C. This step may be performed with or without the presence of an applied magnetic field.

An additional surface treatment may be performed specifically for controlling the magnetic domain structure, said additional surface treatment being preferably a laser treatment.

According to a further preferred embodiment of the processes of the invention, in an additional step, the foil may be shaped with low energy cutting process to have different shapes as washer, E, I and C sections, for specific technical applications such as in a transformer.

According to a preferred embodiment of the invention, additives, that are preferably organic compounds, may be added in the plating solution during the process. Preferably, the additives are selected in the group consisting of:

- complexing agent such as ascorbic acid, glycerine, β-alanine, citric acid, gluconic acid, for inhibiting ferrous ions oxidation;
- anti-stress additives such as sulphur containing organic additives and/or as aluminium derivatives, such as $Al(OH)_3$, for reducing stress in the foil.

Preferably, at least one of this additive may be added in the step of preparation of the aqueous plating solution.

A third object of the present invention is the use of an amorphous $Fe_{100-a-b}P_aM_b$ foil as defined in the first object of the present invention or as obtained by performing one of the processes defined in the second object of the present invention, as a constitutive element of a transformer, generator, motor for frequencies ranging from about 1 Hz to 1000 Hz or more, and for pulsed applications and magnetic applications such as shieldings.

DETAILED DESCRIPTION OF THE PREFERRED EMBODIMENTS

Figure 1:
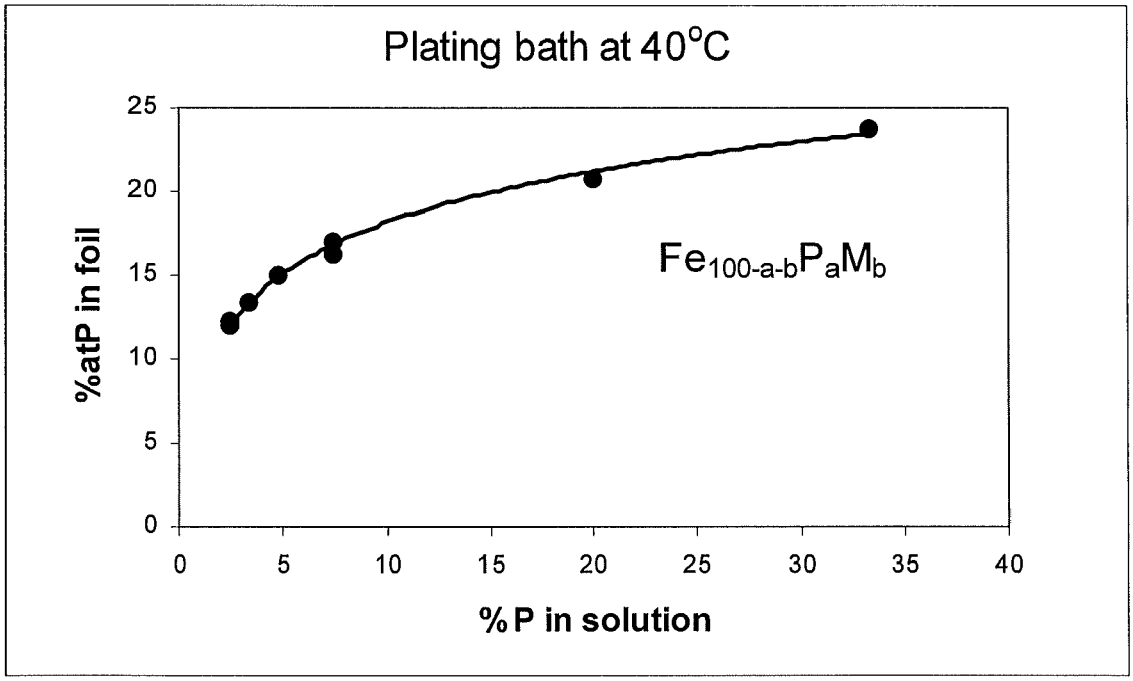
FIG. 1 shows the relation between the atomic % of P in the $Fe_{100-a-b}P_aM_b$ free-standing foils of 50 μm thickness and the concentration of hypophosphite in the aqueous plating bath. The composition of the plating bath and the operating conditions are as described in example 1 of the present invention.

The following aspects or definitions are considered in connection with the present invention.

In the present invention, "amorphous" designates a structure which appears to be amorphous when characterized by XRD, and which shows an amorphous matrix in which small nanocrystals and/or very small nanocrystals are possibly embedded, when characterized by the TEM method, wherein:

- small nanocrystals have a size lower than 20 nanometers
- very small nanocrystals have a size lower than 5 nanometers
- the amorphous matrix occupies more than 85% of the volume of the alloy.

The XRD characterization was made by using an Advance X-ray generator from Bruker with Cu radiation. Scattering angles (2 theta) from 30° to 60° were to measured and the amorphousness was based on the presence or absence of diffraction peaks attributed to large crystals. The TEM observation was done on a high-resolution TEM (HR9000) from Hitachi operated at 300 kV equipped with an EDX detector. The samples for TEM observation were thinned using ultramicrotomy, ion-milling or focus ion beam (FIB).

The percentage of each component was determined by the Inductively Coupled Plasma emission spectral analysis (Optima 4300 DV from Perkin-Elmer®), using appropriate standards and after dissolution of the sample in nitric acid.

The thermal stability of the alloys as a function of the temperature (crystallization temperature and energy released during crystallization) were determined by the differential scanning calorimetry technique (DSC) using a DSC-7 from Perkin-Elmer with a temperature scanning rate of 20 K/min.

Tensile strength from magnetic foil samples was obtained accordingly to ASTM E345 Standard Test Method of Tension Testing of Metallic foil. Under dimensioned standard rectangular specimens 40×10 mm size were cut from magnetic foil sample. The actual foil thickness (typically in the 50 μm range) was measured on each specimen. Load and displacement were recorded from the tensile test at a displacement loading rate of 1 mm/min. The magnetic material exhibits an essential elastic behaviour and no plasticity occurred during the tensile test. The tensile strength of the magnetic material was obtained from the specimen fracture load normalized by the specimen area. The as-deposited specimen elongation at fracture load was deduced from the Young's modulus obtained from nano-indentation tests by using a CSM Nano Hardness Tester apparatus.

The ductility of the foil was evaluated using the ASTM B 490-92 method.

The density of the alloys was determined by the variation of high purity He gas pressure changes in a calibrated volume, using a pycnometer AccuPyc 1330 from Micromeritics and a number of standard materials.

The magnetic measurements shown in this disclosure fall into three categories. First, using a commercial Vibrating Sample Magnetometer (VSM, ADE EV7), the measurements of the basic physical materials properties such as the saturation magnetization and the corresponding coercive field $H_c$ in quasi-static conditions, were performed. Secondly, using an in-house integrating magnetometer, the performances of many similar short samples (1 cm to 4 cm long) were compared, at power frequencies (around 60-64 Hz) for a nearly sine wave applied magnetic field (around 8000 A/m), and by obtaining the losses and corresponding induction and an estimate for $H_c$. Thirdly, by using an in-house integrator for a no-load transformer configuration, similar to a four leg Epstein frame, but with smaller dimensions and with the primary and secondary windings wound tightly onto each leg. The measurements were carried out by integrating the pick-up voltage of the secondary of the sample and of a calibrated air core transformer in series with the sample in order to obtain waveforms for the magnetic induction and applied field strength respectively. A feedback system ensured as near as possible a sine wave induction in the sample. The B—H loops were then integrated to obtain the losses. To allow for a small overlap of each leg at the corners of the sample the weight used to obtain the losses was reduced to that calculated using the path length multiplied by the cross section (which was previously calculated from the total weight divided by the density and by the total length). The power frequency losses, the corresponding value of $H_c$ and the relative permeability $\mu_{rel}$ (Bmax/$\mu_o$Hmax) from analysis of individual B—H loops, were then obtained. Measurements were confirmed for consistency using a commercial hysteresis measurement apparatus (Walker AMH20). Where possible, the values obtained will be associated with the measurement type, i.e. physical, magnetometer or transformer.

Saturation induction ($B_s$)—This magnetic parameter was measured using a commercial VSM or from the transformer measurement (in-house integrator and Walker AMH20).

Low coercive field ($H_c$)—This parameter was quantified using a vibrating sample magnetometer (physical measurement) and an in-house integrating magnetometer (comparative measurement) and a transformer configuration (to obtain $H_c$ as a function of peak induction).

Power frequency losses ($W_{60}$; hysteresis, eddy current and anomalous losses)—This parameter was quantified as a function of peak induction using the in-house transformer configuration and compared between samples using the in-house magnetometer measurement for inductions near to saturation.

Low field relative permeability $\mu_{rel}$ (Bmax/$\mu_0$Hmax)—This parameter was quantified by analyzing the B—H loops of the transformer configuration measurements.

Electrical resistivity ($\rho_{dc}$)—This physical parameter was measured with a four contact direct current method on short samples, with gauge length of about 1 cm (HP current supply, Keithly® nanovoltmeter).

The present invention relates to a free-standing foil made of an amorphous $Fe_{100-a-b}P_aM_b$ soft magnetic alloy with high saturation induction, low coercive field, low power frequency losses and high permeability, said foil being obtained by a process comprising electrodepositing at high current densities, and said foil being useful as ferromagnetic cores of transformers, motors, and generators.

Some preferred embodiments of the process of the invention for preparing amorphous $Fe_{100-a-b}P_aM_b$ soft magnetic alloys as free-standing foils are hereinafter considered in details. These embodiments permit the production, at low cost, of free-standing amorphous alloy foils with remarkably good soft magnetic properties that are very useful for various applications.

In the process of the present invention, the iron and phosphorus precursors are supplied in the aqueous plating solution in the form of salts. The iron precursor can be added by the dissolution of iron scrap of good quality, resulting in a reduction of the production cost associated with the use of pure iron or iron salt.

The concentration of iron salts in the plating solution ranges advantageously from 0.5 to 2.5 M, preferably from 1 to 1.5 M and the concentration of the phosphorus precursor ranges from 0.035 to 1.5 M, preferably from 0.035 to 0.75 M.

Hydrochloric acid and sodium hydroxide may be used in order to adjust the pH of the electrolyte bath.

The calcium chloride additive is advantageously added during preparation of the plating solution to improve the conductivity of the electrolyte bath.

Other additives, such as ammonium chloride can also be used to control the pH of the plating solution.

The control of the impurities concentration is achieved by methods known in the art. The ferric ion concentration in the plating solution is advantageously maintained at a low level, by entering the solution bath in a bag containing iron chips, preferably having a purity level higher than 98.0 weight %. The carbon content in the $Fe_{100-a-b}P_aM_b$ foil is controlled by using starting materials with low carbon impurities and by filtering the aqueous plating solution, preferably with a 2 μm filter. An electrolysis treatment (dummying) is advantageously achieved at the beginning of the formation of the amorphous $Fe_{100-a-b}P_aM_b$ foil in order to reduce the concentration of metallic impurities, such as Pb, in the foil. The amount in organic impurities is reduced, preferably by using activated carbon.

The pH should be controlled to avoid precipitation of ferric compounds and incorporation of iron oxides in the deposit. The pH is advantageously controlled by measuring the pH at the proximity of the electrodes, and by readjusting as quickly as possible in case of deviation. The adjustment is preferably performed by adding is HCl.

Since the presence of oxygen during the process would be prejudicial to the expected performances of the process, the control of the oxygen is performed in the various parts of the electrochemical system. An inert gas is maintained (preferentially argon) over the aqueous plating solution in the plating solution chamber and a preliminary bubbling with nitrogen is advantageously performed in the aqueous plating solution. All parts of the system may advantageously be equipped with air locks in order to prevent any entries of oxygen.

Industrial production of a low-stress free-standing thick foil can be made with reduced production costs, by the use of a dc current, by obtaining good coulombic efficiencies and by achieving a good production rate by the use of high current densities.

The coulombic efficiency (CE)—This process parameter is evaluated from the mass of deposit and from the electrochemical charge consumed during the electrodeposition.

In the method of the present invention, the temperature of the plating solution and the density of the current which is applied between the electrodes are related. Furthermore, the shape of the electrodes, the distance between the electrodes and the velocity of the plating solution are related. The temperature of the plating solution and the type of current applied have an effect on the resulting alloy and on the coulombic efficiency of the process.

In one embodiment, the temperature of the aqueous plating solution is a low temperature, ranging from 40 to 60° C. In the low temperature embodiment:

- the concentration of the iron precursors is about 1 M;
- the aqueous plating solution contains phosphorus precursor with a concentration ranging from 0.035 to 0.12 M;
- the pH of the plating solution is from 1.2 to 1.4;
- the current may be a direct current or a reverse pulse current.

A direct current has preferably a current density from 3 to 20 A/dm$^2$. A reverse pulse current has preferably a reductive current density from 3 to 20 A/dm$^2$ at pulse interval of about 10 msec and a reverse current density of about 1 A/dm$^2$ for an interval of 1-5 millisec.

This low temperature embodiment allows preparation of an amorphous foil with a coulombic efficiency which is from 50 to 70%, and deposition rate from 0.5 to 2.5 μm/min.

If the pH is lower than 1.2, the hydrogen evolution on the working electrode is too high and the coulombic efficiency is reduced and the deposit becomes poor. If the pH is higher than 1.4, the deposit becomes stress and cracked.

At current densities higher than 20 A/dm$^2$, the alloy deposit becomes cracked and stressed and at current densities lower than 3 A/dm$^2$, plating is difficult.

If the working electrode is an RDE in the low temperature embodiment

- rotating rate of the RDE preferably ranges from 500 to 3000 rpm, and consequently, the aqueous plating solution is circulated with a velocity which ranges from 1 to 4 cm/s
- the current may be a direct current or a reverse pulse current. A direct current preferably has a current density y from 3 to 8 A/dm$^2$.

If both electrodes are static parallel plate electrodes,

- the velocity of the aqueous plating solution is of the order of 100 to 320 cm/s
- the current may be a direct current or a reverse pulse current. A direct current preferably has a current density from 4 to 20 A/dm$^2$.

If the working electrode is a rotating drum type electrode combined with a semi-cylindrical curved anode:

- the velocity of the aqueous plating solution is preferably 25 to 75 cm/s;
- the current may be a direct current or a reverse pulse current. A direct current has preferably a current density from 3 to 8 A/dm$^2$.

If low temperature deposition is carried out with a pulse reverse current, the amorphous foil which is obtained has better mechanical properties. The pulse reverse current deposition is known to reduce the hydrogen embrittlement, in case of Ni—P deposits, as mentioned in the literature. Deposits produced in these conditions have a tensile strength in the range of 625-725 MPa as measured accordingly to ASTM E345 Standard Test Method.

In another embodiment, the temperature of the aqueous plating solution is a medium temperature, ranging from 60 to 85° C. This medium temperature embodiment allows production with a higher deposition rate and a higher coulombic efficiency of an amorphous foil according to the invention which has better mechanical properties.

In the medium temperature embodiment:

- the reducing current has a current density from 20 to 80 A/dm$^2$.
- the pH of the plating solution is maintained between 0.9 to 1.2;
- the concentration of the iron salts is preferably about 1 M and the phosphorus precursor concentration is advantageously ranging from 0.12 to 0.5 M.

At current densities higher than 80 A/dm$^2$, the deposits become cracked and stressed and at lower current densities, the plating is difficult. If the pH is lower than 0.9, the hydrogen evolution on the working electrode is too high and the coulombic efficiency is reduced and the deposit became poor. If the pH is higher than 1.2, the deposits become stressed and cracked.

Preferably, the velocity of the solution is of 100 to 320 cm/s with the parallel plate cell and the gap between the cathode and anode is from 0.3 cm to 3 cm The velocity of the aqueous plating solution is adjusted with the concentration of the electroactive species in the plating solution and the gap between the static parallel electrodes in order to deposit elements in the foil at the desired amounts.

The medium temperature embodiment of the process of the invention allows production of an amorphous alloy foil with a coulombic between 50 to 75% and with a deposition rate of 7-15 μm/min.

Even more better results are obtained if the deposition of the foil is carried out at high temperatures between 85 to 105° C.

In the high temperature embodiment of the process:

- the reducing current has a current density of 80 to 150 A/dm$^2$.
- the concentration of the iron salts is of 1 to 1.5 M and the phosphorus precursor concentration is 0.5 to 0.75 M.
- the pH of the solution is maintained between 0.9 to 1.2.

If the high temperature preparation is performed in a static parallel plate cell, the cell chamber and all other plastic equipments are preferably made of polymer material which resists to high temperatures. Preferably, the velocity of the solution in the parallel plate cell ranges from 100 to 320 cm/s and the gap between the static parallel electrodes is from 0.3 cm to 3 cm. The velocity of the aqueous plating solution is adjusted with the concentration of the electroactive species in the bath and the gap between the cathode and anode in order to deposit elements in the foil at the desired amounts.

In the high temperature embodiment of the process of the invention, the coulombic efficiency is between 70 and 83% in these conditions. The production rate of the foil is between 10 and 40 μm/min. The free-standing foil produced in these conditions has a tensile strength around 500 MPa as measured according to ASTM E345 Standard Test Method.

Organic additives can be added to increase the tensile strength. Furthermore, the rotating drum-cell production of this foil is preferably performed at intermediate and high temperatures for the on-line production of the foil.

Details of the invention are hereinafter provided with reference to the following examples which are by no means intended to limit the scope of the invention.

The foils were prepared by electrodeposition in an electrochemical cell wherein the cathode is made of titanium and has different shapes and sizes, the anode is iron, graphite or DSA, and the electrolyte is the aqueous plating solution. The pH of said solution is adjusted by adding NaOH or HCl.

EXAMPLE 1

Rotating Disk Working Electrode

DC Current Density, with or without Cu in the Plating Solution

The present example shows the influence of the atomic % of P on the magnetic properties of the $Fe_{100-a-b}P_aM_b$ free-standing foil.

A number of foils are prepared in an electrochemical cell containing an aqueous plating solution as the electrolyte.

The composition of the aqueous plating solutions used is as follows, wherein the concentration of the P precursor and of the M precursor varies, M being Cu:

$FeCl_2.4H_2O$ 1.0 M $NaH_2PO_2.H_2O$ 0.035-0.5 M $CuCl_2.2H_2O$ 0-0.3 mM $CaCl_2.2H_2O$ 0.5 M

The electrodeposition is performed in an electrochemical cell under the operating conditions:

| | |
|---|---|
| Current densities (dc current): | 3-5 A/dm$^2$ |
| Temperature: | 40° C. |
| pH: | 1.1-1.4 |
| Solution velocity: | 1-4 cm/s |
| Anode: | DSA of 4 cm$^2$ |
| Cathode: | Titanium RDE of 1.3 cm$^2$ |
| Rotating rate of the working electrode: | 900 rpm |
| Distance between the anode and the cathode: | 7 cm |

FIG. 1 shows the relation between the atomic % of P in the $Fe_{100-a-b}P_aM_b$ free-standing foil of 50 μm thickness versus the concentration of the phosphorus precursor in the plating bath. The atomic % of P in the foil increases with the P concentration in solution.

Figure 2:
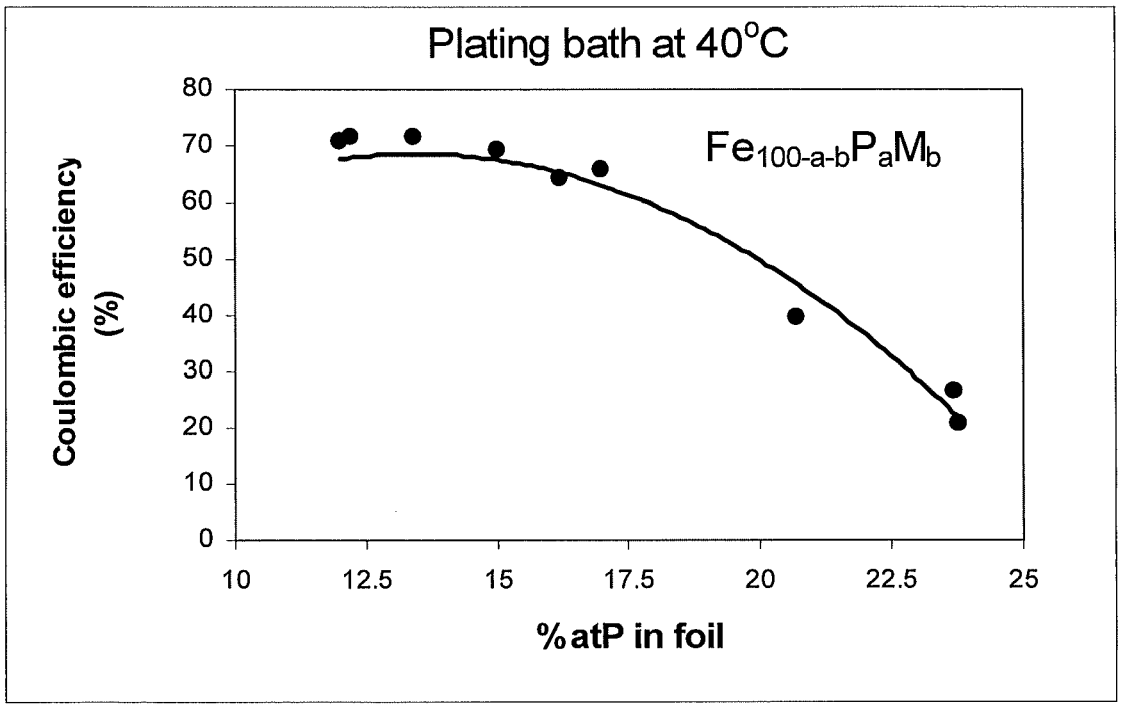
FIG. 2 shows the relation between the atomic % of P in the $Fe_{100-a-b}P_aM_b$ free-standing foils of 50 μm thickness and the coulombic efficiency of the process. The composition of the plating bath and the operating conditions are as described in example 1 of the present invention.

FIG. 2 shows the relation between the concentration of phosphorus in the free-standing foil and the coulombic efficiency. It shows that a good coulombic efficiency of around 70% can be obtained with the atomic % of P ranging from 12 to 18 (and b=0), for the plating bath composition and the electroplating conditions described in example 1.

Figure 3:
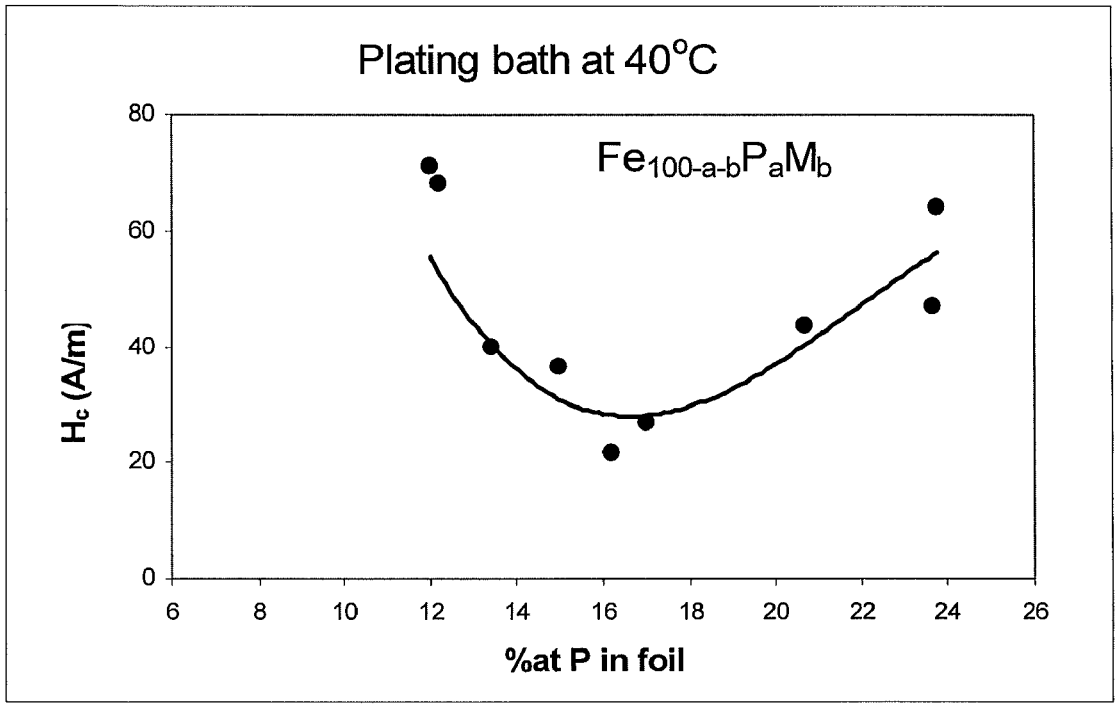
FIG. 3 shows the relation between the coercive field $H_c$ (magnetometer measurement) and the atomic % of P in the $Fe_{100-a-b}P_aM_b$ free-standing foils of 50 μm thickness after annealing thirty minutes at 250° C. The composition of the plating bath and the operating conditions are as described in example 1 of the present invention.
Figure 4:
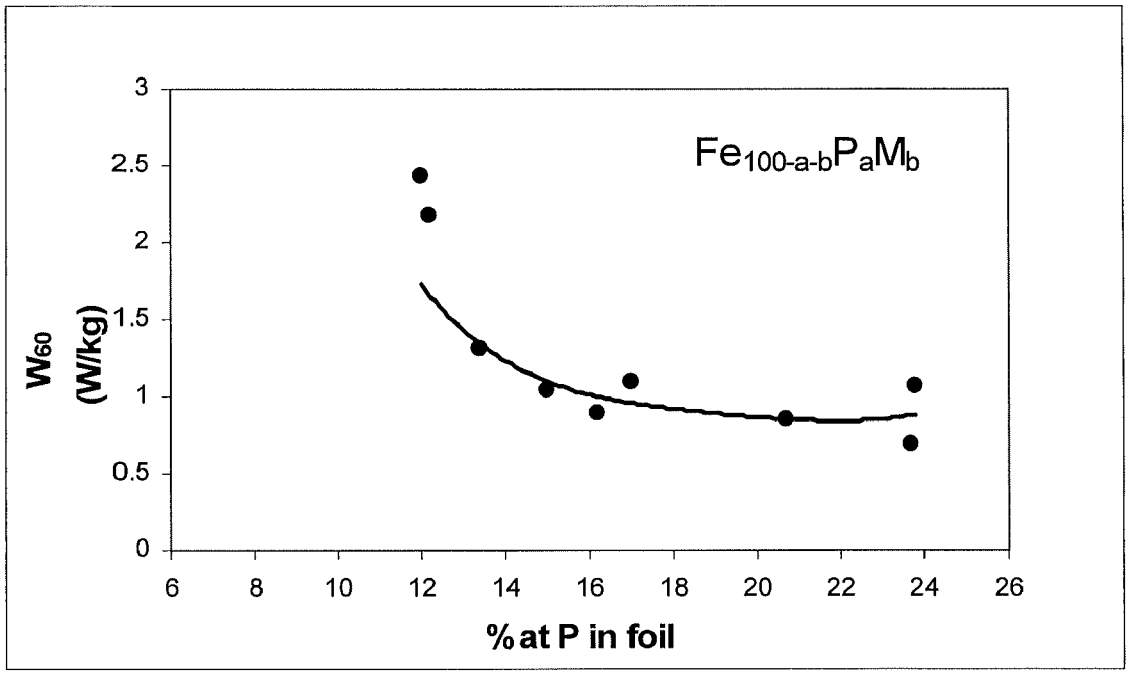
FIG. 4 shows the relation between the power frequency losses ($W_{60}$ magnetometer measurement) and the atomic % of P in the $Fe_{100-a-b}P_aM_b$ free-standing foils of 50 μm thickness after annealing thirty minutes at 250° C. The composition of the plating bath and the operating conditions are as described in example 1 of the present invention.
Figure 5:
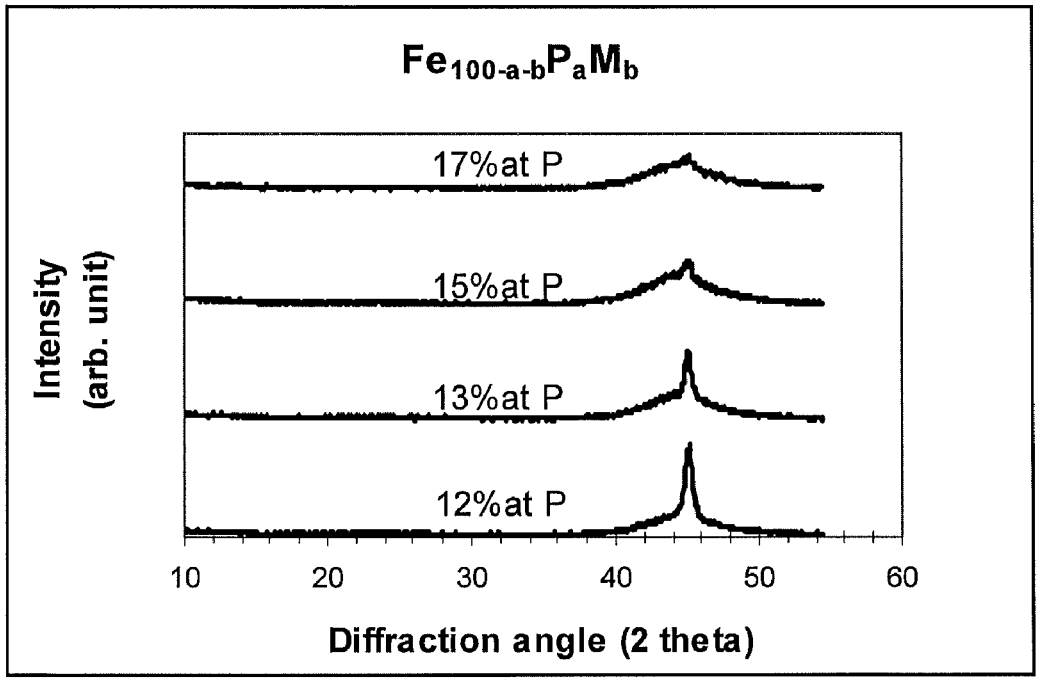
FIG. 5 shows X-ray diffraction patterns of as-deposited (non-annealed) $Fe_{100-a-b}P_aM_b$ foils of 50 μm thickness produced with various compositions of atomic % of P. The composition of the plating bath and the operating conditions are as described in example 1 of the present invention.

The magnetic properties of the $Fe_{100-a-b}P_aM_b$ free-standing foils with the P content ranging from 12 to 24 atomic % and b=0 are described in FIGS. 3 and 4. FIG. 3 shows the effect of the atomic % of P in the foil on the coercive field ($H_c$ magnetometer measurement). $H_c$ shows a minimum at values of P content ranging between 14 to 18 atomic %. FIG. 4 shows the reduced power frequency losses (magnetometer comparative measurement, $W_{60}$) when the atomic % of P increases from 12 to 16% and remains constant up to a value of 24 atomic %. The best magnetic properties are obtained with free-standing foils having an amorphous alloy composition $Fe_{100-a-b}P_a$ (a=15-17 atomic %), as described in FIG. 5 by the X-ray diffraction patterns, which reveal no crystalline peak except for the small region surrounding the foil (edge effect) as seen by the 2D X-ray diffraction. The edge effect is non negligible for free-standing foils produced with the RDE.

Figure 6:
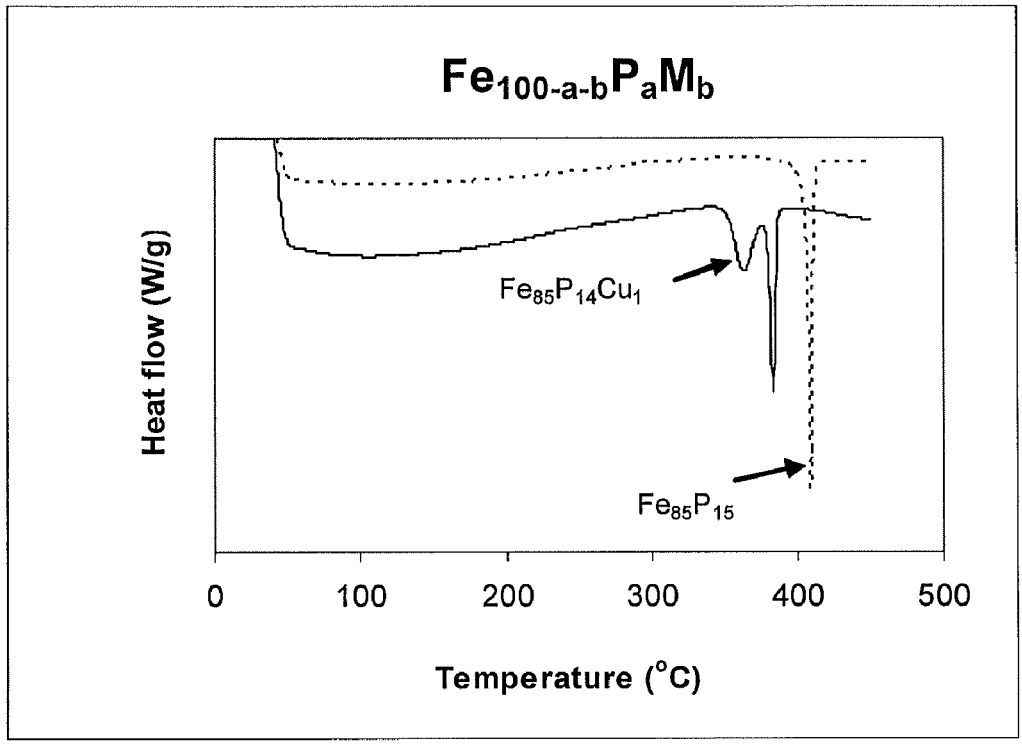
FIG. 6 shows the difference for the differential scanning calorimetry patterns (DSC) obtained with an amorphous $Fe_{85}P_{14}Cu_1$ foil and with an amorphous $Fe_{85}P_{15}$ foil according to the invention. The composition of the plating bath and the operating conditions are as described in example 1 of the present invention.

FIG. 6 shows the DSC spectra of $Fe_{85}P_{15}$ and $Fe_{85}P_{14}Cu_1$ foils obtained according to the present example. The spectrum of the amorphous $Fe_{85}P_{15}$ foil shows one strong exothermic peak at around 410° C., whereas the spectrum of the amorphous $Fe_{85}P_{14}Cu_1$ foil shows the presence of two exothermic peaks at around 366 and 383° C. The as-electrodeposited $Fe_{100-a-1}P_aCu_1$ foil annealed at 250-290° C. before the first exothermic peak shows only amorphous phase for $13 \leqq a \geqq 20$ atomic % of P content. After annealing to the first exothermic peak at 320 to 360° C. depending on the atomic % of P in the film, the deposit consists of bcc Fe phase mixed in the amorphous phase. After annealing to the second exothermic peak around 380° C., the deposit consists of bcc Fe and $Fe_3P$.

Figure 7:
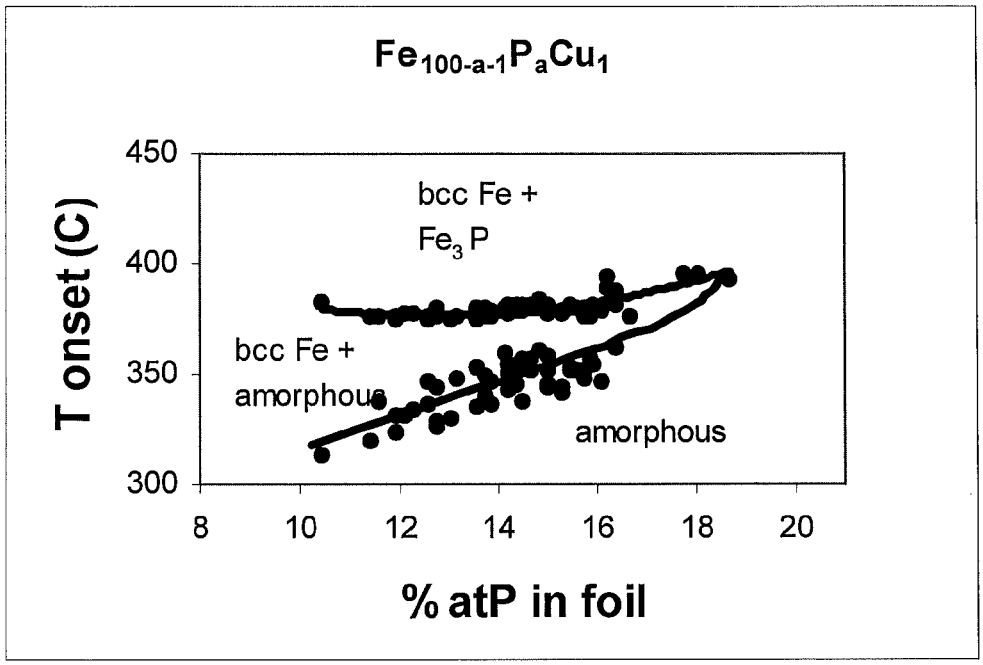
FIG. 7 shows the variation of the onset temperature of the two exothermic DSC peaks versus the atomic % of P in the $Fe_{100-a-b}P_aM_b$ foils. The composition of the plating bath and the operating conditions are as described in example 1 of the present invention.

FIG. 7 shows a strong relation between the first DSC peak onset temperature and the atomic % of P in the foils, with 1 atomic % of Cu. For $Fe_{100-a-1}P_aCu_1$ alloys with the atomic % of P higher than 16% and with 1 atomic % of Cu, the two exothermic peaks no longer exist but only one exothermic peak exists at around 400° C.

Figure 8:
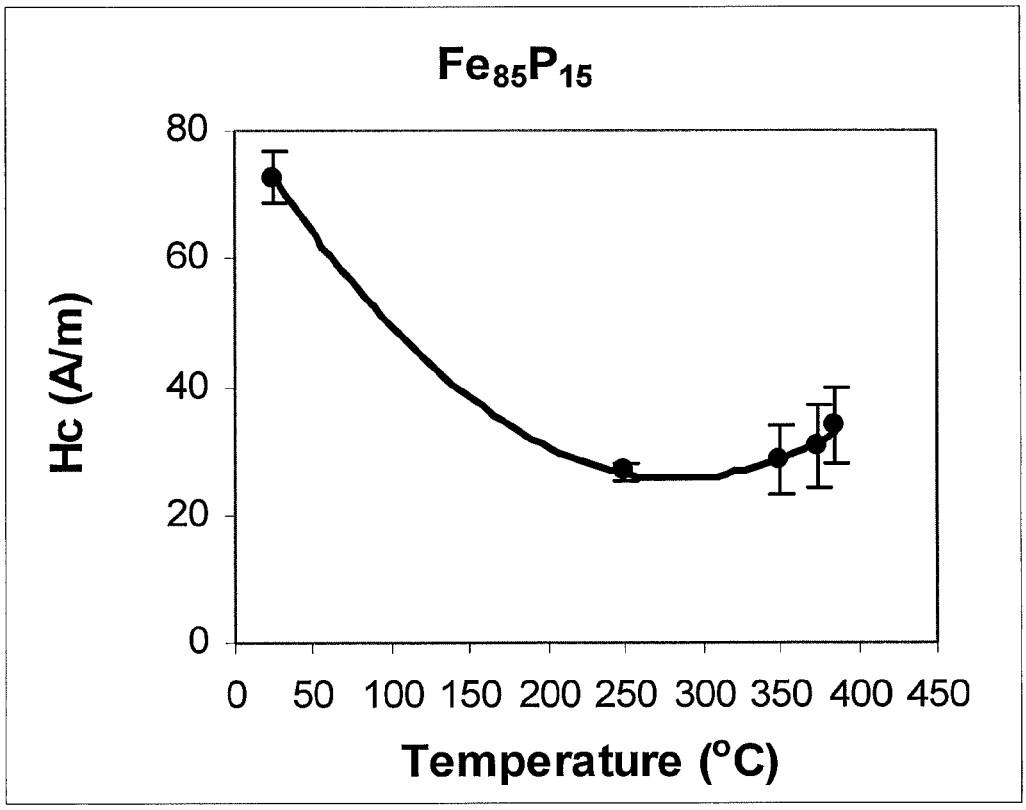
FIG. 8 shows the variation of the coercive field $H_c$ (physical measurement) as a function of a cumulative rapid heat treatment (30 seconds) between 25 to 380° C. for an amorphous $Fe_{85}P_{15}$ foil of the invention. The composition of the plating bath and the operating conditions are as described in example 1 of the present invention.

FIG. 8 shows evolution of the coercive field $H_c$ (physical measurement) of as-deposited amorphous $Fe_{85}P_{15}$ foils for a cumulative rapid heat treatment (30 seconds) between 25° C. and 380° C. $H_c$ decreases from about 73 to 26 A/m as the temperature increases from 25° C. to around 300° C. This drastic change in $H_c$ occurs at a temperature below the crystallization temperature (as seen in FIG. 6) and is probably associated with a stress relieving mechanism and the control of the magnetic domain structure.

EXAMPLE 2

Rotating Disk Working Electrode

Pulsed Reverse Current Density, with Cu in the Plating Solution $Fe_{100-a-b}P_aM_b$ (Where b=1)

A foil was prepared according to the procedure of example 1, except that the current applied is modulated in pulse reverse mode instead of dc mode.

The composition of the aqueous plating solution is:

$FeCl_2.4H_2O$ 1.0 M $NaH_2PO_2.H_2O$ 0.035 M $CuCl_2.2H_2O$ 0.15 mM $CaCl_2.2H_2O$ 0.5 M

The electrodepostion is performed under the following conditions:

Pulsed/reverse current densities:

| | | |
|---|---|---|
| $T_{on}$ | 10 msec | 4.5 A/dm$^2$ |
| $T_{reverse}$ | 1 msec | 1 A/dm$^2$ |
| Temperature of the bath: | 60° C. | |
| pH: | 1.3 | |
| Solution velocity: | 1 cm/s | |
| Anode: | DSA of 4 cm$^2$ | |
| working electrode: | Titanium RDE of 1.3 cm$^2$ | |
| Rotating rate of the working electrode: | 900 rpm | |
| Distance between the anode and the cathode: | 7 cm | |

The material of the resulting free-standing foil has the composition $Fe_{83.5}P_{15.5}Cu_1$. The X-ray diffraction analysis of this sample shows a broad spectrum characteristic of an amorphous alloy. The coulombic efficiency is around 50%.

The thickness of the foil is 70 μm. The coercive field ($H_c$ magnetometer measurement) is 23 A/m after annealing thirty minutes at 265° C. under argon.

EXAMPLE 3

Rotating Disk Working Electrode

Pulsed Reverse Current Density—$Fe_{100-a}P_a$

An amorphous alloy free-standing foil is prepared according the procedure of Example 2, without a M precursor.

The plating solution has the following composition:

$FeCl_2.4H_2O$ 1.0 M $NaH_2PO_2.H_2O$ 0.035 M $CaCl_2.2H_2O$ 0.5 M

The plating is performed under the following conditions:

Pulse reverse current densities:

| | | |
|---|---|---|
| $T_{on}$ | 10 msec | 4.5 A/dm$^2$ |
| $T_{reverse}$ | 1 msec | 1 A/dm$^2$ |
| Temperature of the bath: | 40° C. | |
| pH: | 1.3 | |
| Solution velocity: | 1 cm/s | |
| Anode: | DSA of 4 cm$^2$ | |
| Cathode: | Titanium RDE of 1.3 cm$^2$ | |
| Rotating rate of the working electrode: | 900 rpm | |
| Distance between the anode and the cathode: | 7 cm | |

The resulting free-standing foil has the composition $Fe_{83.8}P_{16.2}$. The X-ray diffraction analysis of this sample shows a broad spectrum characteristic of an amorphous alloy. The coulombic efficiency is 52%. The thickness of the foil is as high as 120 μm. The coercive force ($H_c$ magnetometer measurement) is 13.5 A/m after annealing thirty minutes at 265° C. under argon.

EXAMPLE 4

Pulsed Reverse Current Density

Low Stress—Large Size Foils

An amorphous foil is prepared according to the procedure of example 3, with the exception that static plate electrodes are used to produce a size foil of 90 cm$^2$. The cathode and the anode are placed perpendicular one to the other in the cell.

The plating bath has the following composition:

$FeCl_2.4H_2O$ 1.0 M $NaH_2PO_2.H_2O$ 0.05 M $CuCl_2.2H_2O$ 0.3 mM

The plating is performed under the following conditions:

Pulsed/reverse current densities:

| | | |
|---|---|---|
| $T_{on}$ | 10 msec | 7.5 A/dm$^2$ |
| $T_{reverse}$ | 5 msec | 1 A/dm$^2$ |
| Temperature of the bath: | 60° C. | |
| pH: | 1.3 | |
| Solution velocity: | 30 cm/s | |
| Anode: | Iron plate of 335 cm$^2$ | |
| Cathode: | Titanium plate of 90 cm$^2$ | |
| Distance between the anode and the cathode: | 25 cm | |

The aqueous plating solution is treated on activated carbon a to reduce the ferric ions.

The free standing foil is submitted to a heat treat at 265° C. for 30 minutes in an argon atmosphere.

The resulting free-standing foil has the composition $Fe_{83.2}P_{16.6}Cu_{0.2}$. The X-ray diffraction analysis shows a broad spectrum characteristic of an amorphous alloy. The thickness of the foil is 98 μm. The tensile strength is in the range of 625-725 MPa as measured according to ASTM E345 Standard Test Method. The density for this sample is 7.28 g/cc.

EXAMPLE 5

Static Parallel Plates

An amorphous foil is prepared using a cell having two separated parallel plate electrodes of 10 cm×15 cm. The plating solution has the following composition:

$FeCl_2.4H_2O$ 1.0 M $NaH_2PO_2.H_2O$ 0.08 M $CuCl_2.2H_2O$ 0.02 mM $CaCl_2.2H_2O$ 0.5 M

The plating is performed under the following conditions:

| | |
|---|---|
| Current densities (dc current): | 4 A/dm$^2$ |
| Temperature: | 60° C. |
| pH: | 1.1-1.2 |
| Solution velocity: | 165 cm/s |
| Anode: | DSA plate of 150 cm$^2$ |
| Cathode: | Titanium plate of 150 cm$^2$ |
| Distance between the anode and the cathode: | 10 mm |

The resulting free-standing foil has the composition $Fe_{81.8}P_{17.8}Cu_{0.4}$. The coulombic efficiency is 53%. The thickness of the foil is 70 μm. The electrical resistivity ($\rho_{dc}$) is of 165±15% μΩ·cm.

Figure 9:
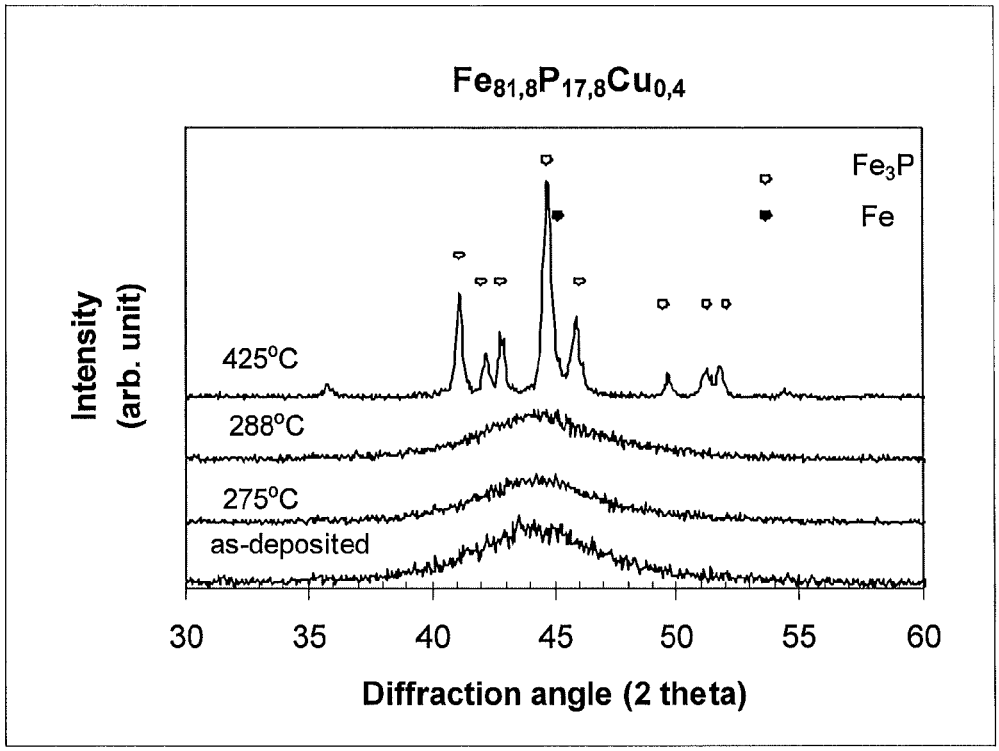
FIG. 9 shows the X-ray diffraction analysis of the $Fe_{81.8}P_{17.8}Cu_{0.4}$ free-standing foil, with the X-ray diffraction patterns obtained for the as-deposited sample and after annealing the sample at three different temperatures, 275, 288 and 425° C. The composition of the plating bath and the operating conditions are as described in example 5 of the present invention.

FIG. 9 shows the X-ray diffraction patterns of the sample as-deposited and as annealed at three different temperatures: 275, 288 and 425° C. The X-ray diffraction patterns are characteristic of amorphous alloys for the sample as-deposited, and the samples annealed at 275 and 288° C., but annealing the foil at temperatures higher than the exothermic peak around 400° C. induces the formation of crystalline bcc Fe and $Fe_3P$.

The magnetic properties are measured after annealing for 5 to 15 minutes at around 275° C. under argon and in a magnetic field produced by permanent magnets that completed a magnetic circuit with the samples.

Several specimens of example 5 are produced to construct an Epstein transformer configuration and annealed around 265° C. for 15 minutes and their magnetic properties are measured.

Figure 10:
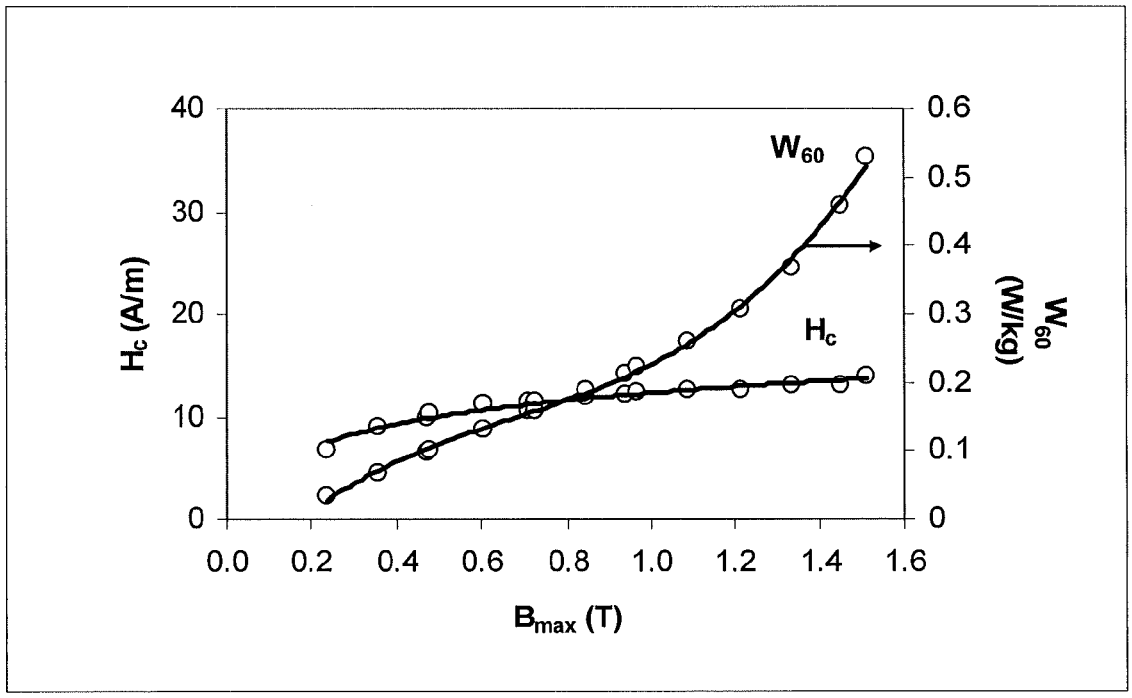
FIG. 10 shows the power frequency losses ($W_{60}$) and corresponding value of coercive field ($H_c$) as a function of the peak induction $B_{max}$ (measured using a transformer Epstein configuration) for samples corresponding to example 5. The composition of the plating bath and the operating conditions are as described in example 5 of the present invention.

FIG. 10 shows the power frequency losses ($W_{60}$) and corresponding value of coercive field ($H_c$) as a function of the peak induction $B_{max}$. The actual losses presented in the Figure are estimated as about 5% higher due to the overlap section of the sample segments so the power frequency losses ($W_{60}$) at peak induction of 1.35 tesla is from 0.39 to 0.41 W/kg. The coercive force ($H_c$) after an induction of 1.35 tesla is 13 A/m±5%. The saturation induction is 1.5 tesla±5%.

Figure 11:
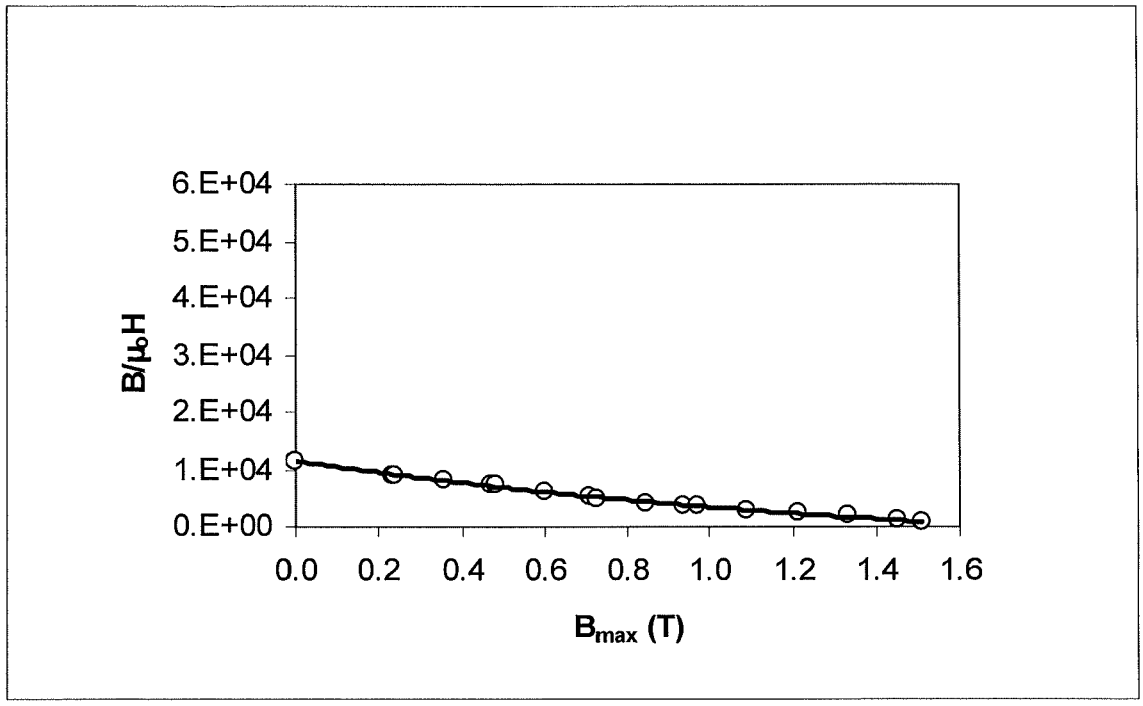
FIG. 11 shows relative permeability ($\mu_{rel}=B_{max}/\mu_0H_{max}$) as a function of the peak induction $B_{max}$ (measured using a transformer Epstein configuration) for samples corresponding to example 5, with the value at zero induction estimated from the maximum slopes of 60 Hz B—H loops at low applied fields. The composition of the plating bath and the operating conditions are as described in example 5 of the present invention.

FIG. 11 shows the relative permeability ($\mu_{rel}=B_{max}/\mu_0 H_{max}$) as a function of the peak induction $B_{max}$. The value at zero induction is estimated from the maximum slopes of 60 Hz B—H loops at low applied fields. The maximum relative permeability ($\mu_{rel}$) is 11630±10%.

EXAMPLE 6

Rotating Drum Type Cell

DC Current Density

An foil was prepared in a cell having a rotating drum cathode of titanium partially immersed in the plating solution, and a semi-cylindrical curved DSA anode facing the rotating drum cathode. Dc current is applied to the electrodes.

The plating has the following composition:

$FeCl_2.4H_2O$ 1.0 M $NaH_2PO_2.H_2O$ 0.08 M $CuCl_2.2H_2O$ 0.02 mM $CaCl_2.2H_2O$ 0.5 M

The plating is performed under the following conditions:

| | |
|---|---|
| Current densities | 6 A/dm$^2$ |
| Temperature: | 60° C. |
| pH: | 1.0-1.1 |
| Solution velocity: | 36 cm/s |
| Rotating drum rotating rate: | 0.05 rpm |
| Anode: | Semi-cylindrical DSA of 20 cm diameter and 15 cm length |
| Cathode: | Drum made of Ti of 20 cm diameter and 15 cm length |
| Distance between the anode and the cathode: | 10 mm |

The resulting free-standing foil has the composition $Fe_{82.0}P_{16.6}Cu_{1.4}$.

The X-ray diffraction analysis of this sample shows a broad spectrum characteristic of an amorphous alloy. The coercitive force ($H_c$ magnetometer measurement) is 41.1 A/m after annealing 15 minutes at around 275° C. under argon and in a magnetic field produced by permanent magnets that completed a magnetic circuit with the samples. The coulombic efficiency is 50%. The thickness of the foil is 30 μm.

EXAMPLE 7

Sulphate Bath

An amourphous foil is prepared with iron sulphate instead of iron chloride as the iron precursor.

The plating solution is:

$FeSO_4.7H_2O$ 1 M $NaH_2PO_2.H_2O$ 0.085 M $NH_4Cl$ 0.37 M $H_3BO_3$ 0.5 M

Ascorbic acid 0.03 M

The plating is performed under the following conditions:

| | |
|---|---|
| Current densities (dc current): | 10 A/dm$^2$ |
| Temperature: | 50° C. |
| pH: | 2.0 |
| Solution velocity: | 2 cm/s |
| Anode: | Iron of 2.5 cm$^2$ |
| Cathode: | Titanium RDE of 2.5 cm$^2$ |
| Rotating rate of the working electrode: | 1500 rpm |
| Distance between the anode and the cathode: | 7 cm |

The resulting free-standing foil has the composition $Fe_{78.5}P_{21.5}$ (b=0).

The X-ray diffraction analysis of this sample shows a broad spectrum characteristic of an amorphous alloy. Mechanical properties of the free-standing foil in the present example are less performing than to those obtained in example 1. Foils made in sulphate baths are more stressed and brittle than those produced in chloride baths at the same temperature. The coercive force ($H_c$ magnetometer measurement) is 24.0 A/m after annealing 15 minutes at 275° C. under argon and in a magnetic field produced by permanent magnets that completed a magnetic circuit with the samples. The coulombic efficiency is 52% and the thickness of the foil is 59 μm.

EXAMPLE 8

Thick Foils

A free-standing foil is produced at high thickness using a pulsed reverse current mode and the RDE cell.

The plating solution has the following composition:

$FeCl_2.4H_2O$ 1.0 M $NaH_2PO_2.H_2O$ 0.035 M $CuCl_2.2H_2O$ 0.15 mM $CaCl_2.2H_2O$ 0.5 M

The plating is performed under the following conditions:

Pulsed/reverse current densities:

| | | |
|---|---|---|
| $T_{on}$ | 10 msec | 4.5 A/dm$^2$ |
| $T_{reverse}$ | 1 msec | 1 A/dm$^2$ |
| Temperature of the bath: | 60° C. | |
| pH: | 1.3 | |
| Solution velocity: | 1 cm/s | |
| Anode: | DSA of 4 cm$^2$ | |
| Cathode: | Titanium RDE of 1.3 cm$^2$ | |
| Rotating rate of the working electrode: | 900 rpm | |
| Distance between the anode and the cathode: | 7 cm | |

The resulting free-standing foil has the composition $Fe_{82.9}P_{15.5}Cu_{1.6}$. The coulombic efficiency is around 50%. The thickness of the foil is as high as 140 μm. Foil with thickness higher than 140 μm can be produced in these conditions by simply increasing the duration of the deposition. The coercive force ($H_c$ magnetometer measurement) of the foil is 13.5 A/m after annealing 15 minutes at 275° C. under argon and in a magnetic field produced by permanent magnets that completed a magnetic circuit with the samples.

EXAMPLE 9

$Fe_{100-a-b}P_aMo_b$

A $Fe_{100-a-b}P_aMo_b$ free-standing foil is produced in a cell having a rotating disk electrode (RDE) of titanium as working electrode and DSA anode.

The plating solution is:

$FeCl_2.4H_2O$ 0.5 M $NaH_2PO_2.H_2O$ 0.037 M $NaMoO_4.2H_2O$ 0.22 mM $CaCl_2.2H_2O$ 1.0 M

The plating is performed under the following conditions: Pulsed/reverse current densities:

| | | |
|---|---|---|
| $T_{on}$ | 10 msec | 6 A/dm$^2$ |
| $T_{reverse}$ | 1 msec | 1 A/dm$^2$ |
| Temperature: | 60° C. | |
| pH: | 1.3 | |
| Solution velocity: | 1 cm/s | |
| Anode: | DSA of 4 cm$^2$ | |
| Cathode: | Titanium RDE of 1.3 cm$^2$ | |
| Rotating rate of the working electrode: | 900 rpm | |
| Distance between the anode and the working electrode: | 7 cm | |

The resulting free-standing foil has the composition $Fe_{83.7}P_{15.8}Mo_{0.5}$. The X-ray diffraction analysis shows a broad spectrum characteristic of an amorphous alloy. The coercive force $H_c$ (magnetometer measurement) of the foil is 20.1 A/m after annealing 15 minutes at 275° C. under argon and in a magnetic field produced by permanent magnets that completed a magnetic circuit with the samples. The coulombic efficiency is around 56%. The thickness of the deposit is 100 μm.

EXAMPLE 10

$Fe_{100-a-b}P_a(MoCu)_b$ $Fe_{100-a-b}P_a(MoCu)_b$ free-standing foils are produced in a cell having a rotating disk electrode (RDE) of titanium as working electrode and an iron anode.

The composition of the plating solution is:

$FeCl_2.4H_2O$ 1 M
$NaH_2PO_2.H_2O$ 0.037 M
$NaMoO_4.2H_2O$ 0.02 M
$CaCl_2.2H_2O$ 0.3 M
$CuCl_2$ 0.3 mM
Citric acid 0.5 M The plating is performed under the following conditions: Pulsed/reverse current densities:

| | | |
|---|---|---|
| $T_{on}$ | 10 msec | 30 A/dm$^2$ |
| $T_{reverse}$ | 10 msec | 5 A/dm$^2$ |
| Temperature: | 60° C. | |
| pH: | 0.8 | |
| Solution velocity: | 3 cm/s | |
| Anode: | Iron of 2.5 cm$^2$ | |
| Cathode: | Titanium RDE of 2.5 cm$^2$ | |
| Rotating rate of the working electrode: | 2500 rpm | |
| Distance between the anode and the cathode: | 7 cm | |

The resulting free-standing foil has the composition $Fe_{74.0}P_{23.6}Cu_{0.8}Mo_{1.6}$.

EXAMPLE 11

High Temperature and DC Current Density For Good Mechanical Properties

The mechanical properties of the free-standing foils deposited in a plating solution at 40 to 60° C. with a dc applied current are low. In order to increase the ductility and the tensile strength of these foils, the temperature of the bath was increased from 40 to 95° C.

The cell used has two separated parallel plate electrodes of 2 cm×5 cm.

The plating composition of the plating solution is:

$FeCl_2.4H_2O$ 1.3-1.5 M
$NaH_2PO_2.H_2O$ 0.5-0.75 M

The plating is performed under the following conditions:

| | |
|---|---|
| Current densities (dc current): | 50-110 A/dm$^2$ |
| Temperature: | 95° C. |
| pH: | 1.0-1.15 |
| Solution velocity: | 300 cm/s |
| Anode: | Plate of Graphite 10 cm$^2$ |
| Cathode: | Plate of Ti 10 cm$^2$ |
| Distance between the anode and the cathode: | 6 mm |

Figure 12:
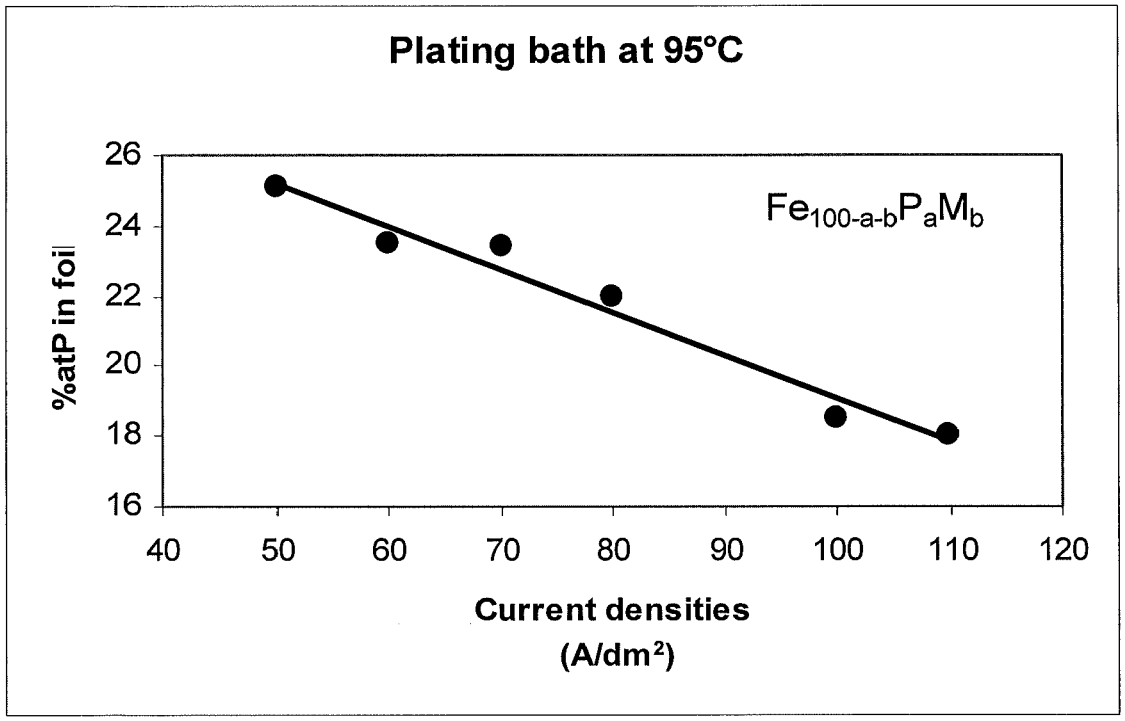
FIG. 12 shows a relation between the atomic % of P in the $Fe_{100-a-b}P_aM_b$ free-standing foils of 20-50 μm thickness and the current densities—the composition of the plating bath and the operating conditions are as described in example 11 of the present invention.

FIG. 12 shows a relation between the atomic % of P in the free-standing foil of around 50 μm thickness and the current densities in a plating solution operated at 95° C. The atomic % of P in the foil decreases with the current densities in these conditions of the solution concentration of iron and phosphorus and these hydrodynamic conditions.

Figure 13:
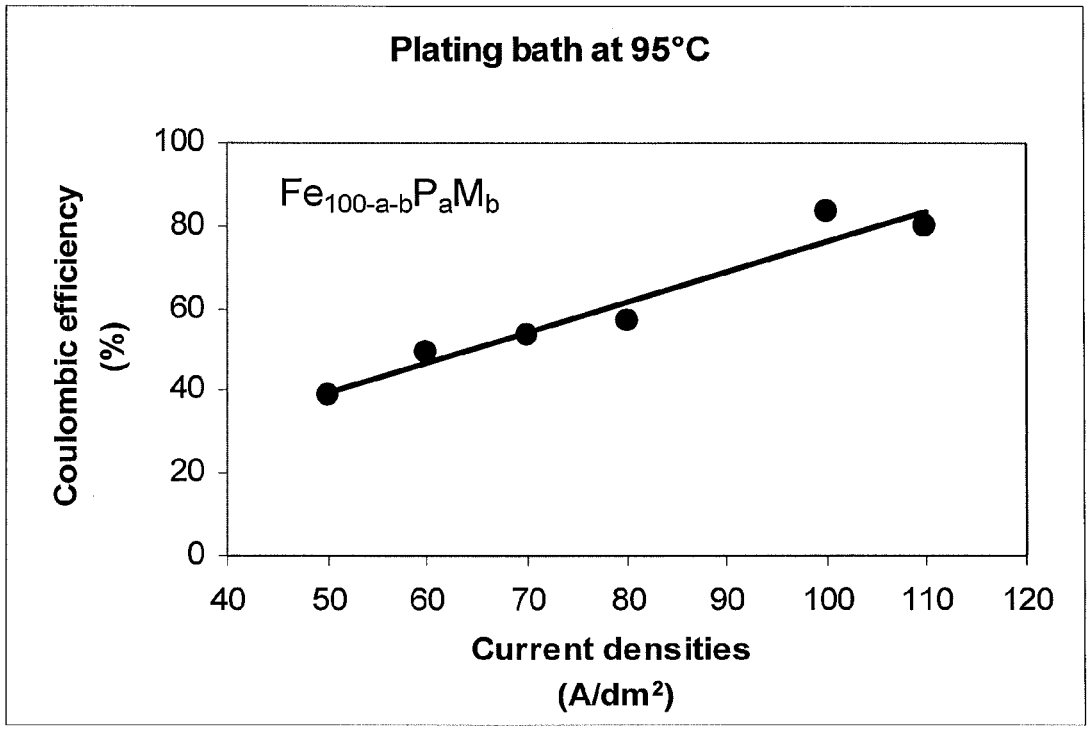
FIG. 13 shows a relation between the coulombic efficiency of the $Fe_{100-a-b}P_aM_b$ foil plating process and the current densities, with the $Fe_{100-a-b}P_aM_b$ free-standing foils having a 20-50 μm thickness. The composition of the plating bath and the operating conditions are as described in example 11 of the present invention.

FIG. 13 shows that the coulombic efficiency decreases as the atomic % of P in the foil increases. A good coulombic efficiency of around 80% is obtained for the electrodeposition of free-standing foils having a P content ranging from 16 to 18 atomic %, for the plating solution and the electroplating conditions described in the present example. The ductility of these free-standing foils deposited in a bath at elevated temperature is around 0.8% and the tensile strength around 500 MPa.

Figure 14:
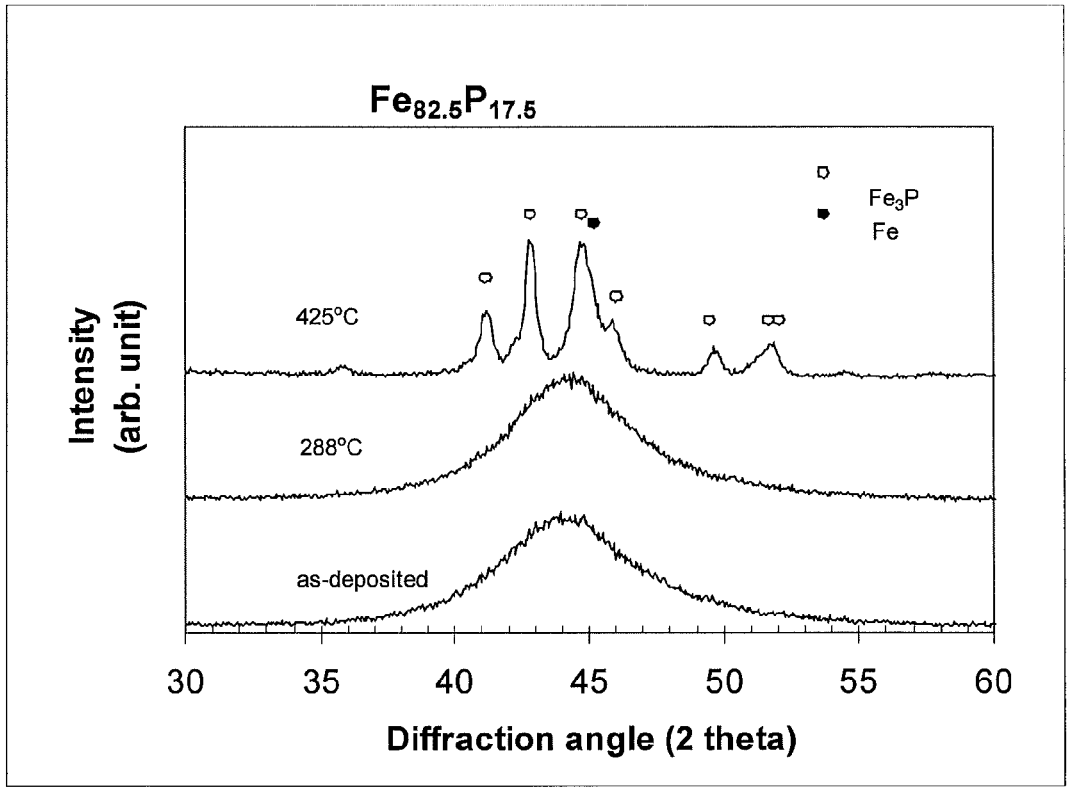
FIG. 14 shows the X-ray diffraction analysis of the $Fe_{82.5}P_{17.5}$ free-standing foil, with the X-ray diffraction patterns obtained for the as-deposited sample and after annealing the sample at two different temperatures, 288 and 425° C. The composition of the plating bath and the operating conditions are as described in example 11 of the present invention.

A specimen of the free-standing foil of example 11 has the composition $Fe_{82.5}P_{17.5}$. FIG. 14 shows the X-ray diffraction patterns obtained at three different temperatures: 25, 288 and 425° C. The X-ray diffraction patterns are amorphous at 25 and 288° C., but annealing the foil at temperatures higher than the exothermic peak around 400° C. induces the formation of crystalline bcc Fe and $Fe_3P$. The resulting amorphous alloy free-standing foil has an electrical resistivity ($\rho_{dc}$) of 142±15% μΩ·cm.

Several specimen are produced according to the procedure of the present example 11, to construct an Epstein transformer configuration and annealed fifteen minutes at 265° C. and measured for the magnetic properties.

Figure 15:
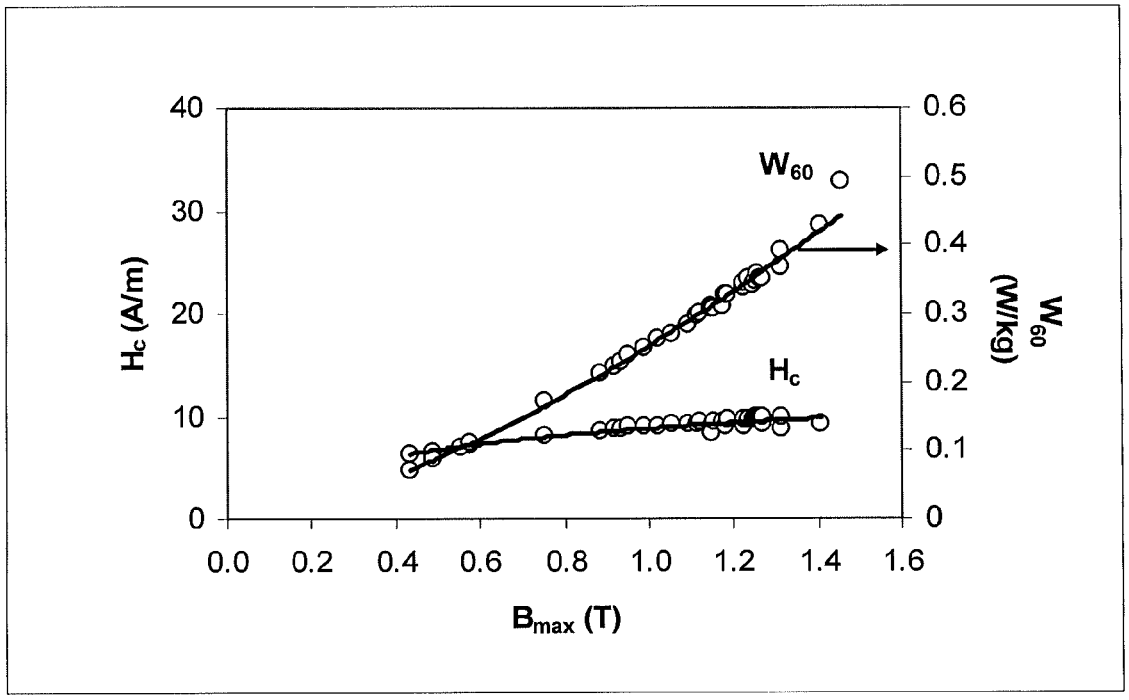
FIG. 15 shows the power frequency losses ($W_{60}$) and corresponding value of coercive field ($H_c$) as a function of the peak induction $B_{max}$ (measured using a transformer Epstein configuration) for samples corresponding to example 11. The composition of the plating bath and the operating conditions are as described in example 11 of the present invention.

FIG. 15 shows the power frequency losses ($W_{60}$) and corresponding value of coercive field ($H_c$) as a function of the peak induction $B_{max}$. The actual losses presented in the Figure are estimated as about 10% higher due to the overlap section of the sample segments so the power frequency losses ($W_{60}$) at peak induction of 1.35 tesla is from 0.395 to 0.434 W/kg. The coercive force ($H_c$) after an induction of 1.35 tesla is 9.9 A/m±5%. The saturation induction is 1.4 tesla±5%.

Figure 16:
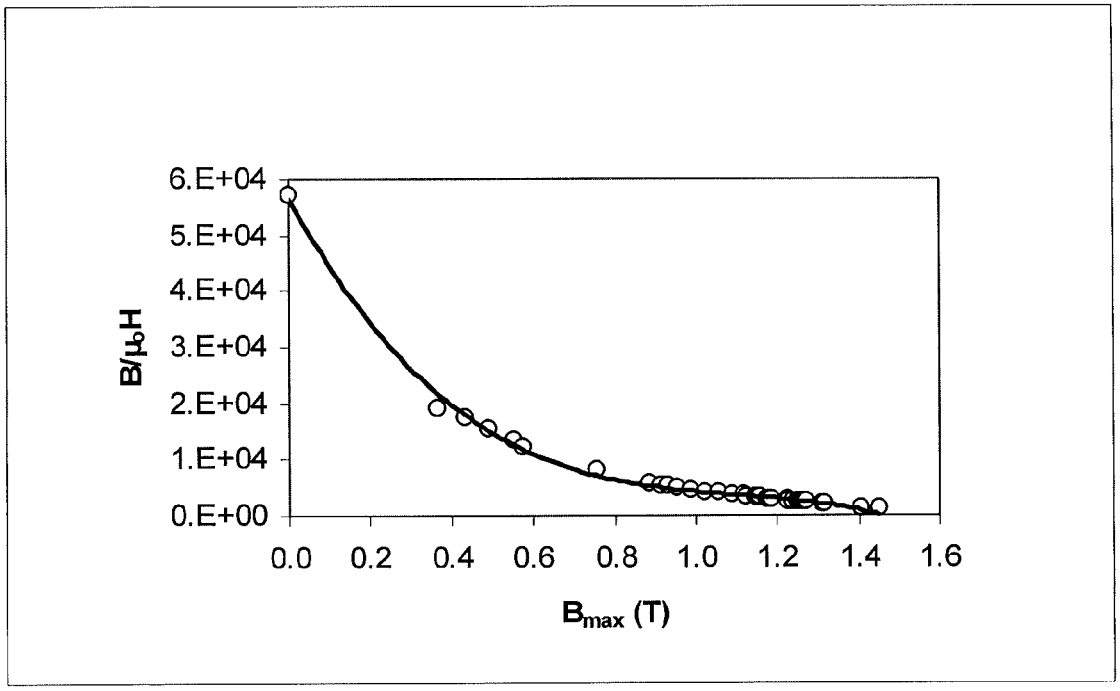
FIG. 16 shows relative permeability ($\mu_{rel}=B_{max}/\mu_0H_{max}$) as a function of the peak induction $B_{max}$ (measured using a transformer Epstein configuration) for samples corresponding to example 11, with the value at zero induction estimated from the maximum slopes of 60 Hz B—H loops at low applied fields. The composition of the plating bath and the operating conditions are as described in example 11 of the present invention.

FIG. 16 shows the relative permeability ($\mu_{rel}=B_{max}/\mu_0 H_{max}$) as a function of the peak induction $B_{max}$. The value at zero induction is estimated from the maximum slopes of 60 Hz B—H loops at low applied fields. The maximum relative permeability ($\mu_{rel}$) is 57100±10%.

EXAMPLE 12

High Temperature, High DC Current Density, Thick Deposit

A free-standing foil of around 100 μm thickness is produced in this example. The cell is the same as the one used in example 11 and the plating solution is operated at 95° C. The plating solution is:

$FeCl_2.4H_2O$ 1.5 M
$NaH_2PO_2.H_2O$ 0.68 M

The plating is performed under the following conditions:

| | |
|---|---|
| Current densities: | 110 A/dm$^2$ |
| Temperature: | 95° C. |
| pH: | 0.9 |
| Solution velocity: | 300 cm/s |
| Anode: | Plate of Graphite 10 cm$^2$ |
| Cathode: | Plate of Ti 10 cm$^2$ |
| Distance between the anode and the cathode: | 6 mm |

The resulting free-standing foil has the composition $Fe_{79.7}P_{20.3}$. The X-ray diffraction analysis of this sample shows a broad spectrum characteristic of an amorphous alloy as shown in FIG. 12. The coercive force $H_c$ (magnetometer measurement) of the foil is 26.7 A/m after annealing fifteen minutes at 275° C. under argon and in a magnetic field produced by permanent magnets that completed a magnetic circuit with the samples. The measure of the density for this sample is 7.28 g/cc. The coulombic efficiency is near 70%. The thickness of the deposit is as high as 100 μm. Deposits with thickness higher than 100 μm can be produced in these conditions by simply increasing the duration of the deposition.

It has thus been shown that according to the present invention, a transition metal-phosphorus alloy having the desirable properties has been provided in the form of a free-standing foil, as well as the method of production thereof.

While preferred embodiments of the invention have been described above and illustrated in the accompanying drawings, it will be evident to those skilled in the art that modifications may be made therein without departing from the essence of this invention. Such modifications are considered as possible variants comprised in the scope of the invention.

The invention claimed is:

1. A method for the preparation of an amorphous $Fe_{100-a-b}P_aM_b$ alloy, in the form of a free-standing foil, wherein:

said foil has an average thickness in the range 20 μm-250 μm;

in formula $Fe_{100-a-b}P_aM_b$, a is a number ranging from 13 to 24, b is a real number ranging from 0 to 4, and M is at least one transition element other than Fe;

the alloy has an amorphous matrix in which nanocrystals having a size lower than 20 nm may be embedded, and the amorphous matrix occupies more than 85% of the volume of the alloy, wherein said method comprises electrodeposition of an alloy deposit using an electrochemical cell having a working electrode which is the substrate for alloy deposition and an anode, said electrochemical cell contains an electrolyte solution which acts as a plating solution and a dc current or a pulse current is applied between the working electrode and the anode, the plating solution is an aqueous solution with a pH ranging from 0.8 to 2.5 and a temperature ranging from 60° C. to 105° C., which contains:

an iron precursor at a concentration ranging from 0.5 to 2 M, selected from the group consisting of a clean iron scrap, iron, pure iron, and a ferrous salt, said ferrous salt selected from the group consisting of $FeCl_2$, $Fe(SO_3NH_2)_2$, $FeSO_4$ and mixtures thereof;

a phosphorus precursor selected from the group consisting of $NaH_2PO_2$, $H_3PO_2$, $H_3PO_3$, and mixtures thereof, at a concentration ranging from 0.035-1.5 M; and optionally a M salt at a concentration ranging from 0.1 to 500 mM;

a dc or pulse current is applied between the working electrode and the anode with a density ranging from 3 to 150 A/dm$^2$;

wherein the working electrode and the anode are static parallel plate electrodes, and the velocity of the aqueous plating solution is of the order of 100 to 320 cm/s and the gap between the static parallel electrodes is from 0.3 cm to 3 cm.

2. A method according to claim 1, which further comprises a step of peeling the alloy deposit from the working electrode.

3. A method according to claim 1, wherein the ferric ion concentration in the aqueous plating solution is maintained at a low level by reducing ferric ions by recirculating the aqueous plating solution in a regenerator, containing iron chips.

4. A method according to claim 1, wherein the anode in the electrochemical cell is made of iron or graphite or is a DSA (Dimensionally Stabilized Anode).

5. A method according to claim 1, wherein the anode has at least the same surface dimension as the working electrode.

6. A method according to claim 1, wherein the anode is made of iron, and is isolated from the working electrode by a porous membrane.

7. A method according to claim 1, wherein the working electrode is made of an electroconductive metal or metallic alloy.

8. A method according to claim 7, wherein the working electrode is made of titanium, brass, hard chrome plated stainless steel or stainless steel.

9. A method according to claim 1, wherein the temperature of the aqueous plating solution ranges from 60 to 85° C., and:

the reducing current has a current density from 20 to 80 A/dm2;

the pH of the plating solution is maintained between 0.9 to 1.2; and the concentration of the iron salts is about 1 M and the phosphorus precursor concentration is ranging from 0.12 to 0.5 M.

10. A method according to claim 1, wherein the temperature of the plating solution ranges from 85 to 105° C., and:

the reducing current has a current density of 80 to 150 A/dm$^2$;

the concentration of the iron salts is of 1 to 1.5 M and the phosphorus precursor concentration is 0.5 to 0.75 M; and the pH of the solution is maintained between 0.9 to 1.2.

11. A method according to claim 1, comprising an additional step of thermal treatment of the amorphous $Fe_{100-a-b}P_aM_b$ foil, said additional step being performed at a temperature ranging from 200 to 300° C. with or without the presence of an applied magnetic field.

12. A method according to claim 1, comprising an additional step of mechanical or chemical polishing of the amorphous $Fe_{100-a-b}P_aM_b$ foil.

13. A method according to claim 1, comprising an additional surface treatment, said additional surface treatment being a laser treatment.

14. A method according to claim 1, wherein additives are added during the method, wherein said additives are selected from:

a complexing agent for inhibiting ferrous ions oxidation, selected from ascorbic acid, glycerine, 13-alanine, citric acid, and gluconic acid;

an agent for reducing the ferric ions, selected from hydroquinone and hydrazine; or anti-stress additives for reducing stress in the foil, said anti-stress additives being sulphur containing organic additives and/or $Al(OH)_3$, at least one of these additives being added in a step of preparation of the aqueous plating solution.

15. A method for the preparation of an amorphous $Fe_{100-a-b}P_aM_b$ alloy, in the form of a free-standing foil, wherein:

said foil has an average thickness in the range 20 μm-250 μm;

in formula $Fe_{100-a-b}P_aM_b$, a is a number ranging from 13 to 24, b is a real number ranging from 0 to 4, and M is at least one transition element other than Fe;

the alloy has an amorphous matrix in which nanocrystals having a size lower than 20 nm may be embedded, and the amorphous matrix occupies more than 85% of the volume of the alloy, wherein said method comprises electrodeposition of an alloy deposit using an electrochemical cell having a working electrode which is the substrate for alloy deposition and an anode, said electrochemical cell contains an electrolyte solution which acts as a plating solution and a dc current or a pulse current is applied between the working electrode and the anode, the plating solution is an aqueous solution with a pH ranging from 0.8 to 2.5 and a temperature ranging from 60° C. to 105° C., which contains:

an iron precursor, at a concentration ranging from 0.5 to 2 M, selected from the group consisting of a clean iron scrap, iron, pure iron, and a ferrous salt, said ferrous salt selected from the group consisting of $FeCl_2$, $Fe(SO_3NH_2)_2$, $FeSO_4$ and mixtures thereof;

a phosphorus precursor selected from the group consisting of $NaH_2PO_2$, $H_3PO_2$, $H_3PO_3$, and mixtures thereof, at a concentration ranging from 0.035-1.5 M; and optionally a M salt at a concentration ranging from 0.1 to 500 mM;

a dc or pulse current is applied between the working electrode and the anode with a density ranging from 3 to 150 $A/dm^2$;

wherein the working electrode and the anode are static parallel plate electrodes, and the velocity of the aqueous plating solution ranges from 100 to 320 cm/s and the gap between the static parallel electrodes is from 0.3 cm to 3 cm, and wherein the working electrode is made of titanium and is polished before use.

* * * * *